US007347284B2

(12) United States Patent
Arian et al.

(10) Patent No.: US 7,347,284 B2
(45) Date of Patent: Mar. 25, 2008

(54) APPARATUS AND METHOD FOR HARD ROCK SIDEWALL CORING OF A BOREHOLE

(75) Inventors: Abbas Arian, Houston, TX (US); Bruce Mackay, Missouri City, TX (US); Randall Jones, Sugar Land, TX (US); Ken Smith, Sugar Land, TX (US); Wes Ludwig, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 10/969,165

(22) Filed: Oct. 20, 2004

(65) Prior Publication Data

US 2006/0081398 A1 Apr. 20, 2006

(51) Int. Cl.
*E21B 49/06* (2006.01)
*E21B 25/00* (2006.01)

(52) U.S. Cl. ..... 175/78; 175/58; 175/249; 175/251

(58) Field of Classification Search ..... 175/58, 175/78, 249–255
See application file for complete search history.

(56) References Cited

U.S. PATENT DOCUMENTS

| | | | | | |
|---|---|---|---|---|---|
| 2,252,620 | A | * | 8/1941 | De Long Raleigh | 175/81 |
| 2,327,023 | A | | 8/1943 | Danner | 255/1.4 |
| 2,513,398 | A | * | 7/1950 | Benke | 175/78 |
| 2,599,405 | A | | 6/1952 | Mennecier | 255/1.4 |
| 2,646,252 | A | | 7/1953 | Hylbak | 255/1.4 |
| 3,093,014 | A | * | 6/1963 | Graf | 74/822 |
| 3,187,284 | A | | 6/1965 | Gauban | 175/78 |
| 3,187,824 | A | * | 6/1965 | Gauban | 175/78 |
| 3,405,772 | A | * | 10/1968 | Wisenbaker et al. | 175/77 |
| 3,525,406 | A | * | 8/1970 | Hart | 340/853.6 |
| 4,396,074 | A | | 8/1983 | Jageler et al. | 175/78 |
| 4,671,100 | A | * | 6/1987 | Doussiet | 73/38 |
| 4,714,119 | A | * | 12/1987 | Hebert et al. | 175/20 |
| 4,950,844 | A | * | 8/1990 | Hallmark et al. | 175/59 |
| 5,411,106 | A | | 5/1995 | Maissa et al. | 175/78 |
| 5,676,213 | A | | 10/1997 | Auzerais et al. | 175/58 |
| 6,186,228 | B1 | | 2/2001 | Wegener et al. | 166/249 |
| 6,227,293 | B1 | | 5/2001 | Huffman et al. | 166/248 |
| 6,230,799 | B1 | | 5/2001 | Slaughter et al. | 166/249 |

(Continued)

OTHER PUBLICATIONS

International Search Report for PCT/US05/36472 Mailed Oct. 26, 2006.

*Primary Examiner*—Giovanna C Wright
(74) *Attorney, Agent, or Firm*—Paul R. Morico; Baker Botts L.L.P.

(57) ABSTRACT

The present invention is directed to an apparatus and method for coring a borehole in a hard rock sidewall of a well bore in a subterranean formation for testing purposes. The apparatus includes a drive motor for operation down hole, a flexible drive shaft coupled to the drive motor and a coring bit coupled to the flexible drive shaft, such that the coring bit is directly driven by the drive motor. The apparatus also includes a control circuit for controlling advancement of the coring bit into the subterranean formation. The apparatus also includes a rotating carousel for storing multiple core samples. The method includes the steps of activating the drive motor to rotate the output shaft; coupling the output shaft of the drive motor to the flexible drive shaft and rotating the coring bit with the flexible drive shaft.

47 Claims, 30 Drawing Sheets

U.S. PATENT DOCUMENTS

| | | | | |
|---|---|---|---|---|
| 6,241,019 | B1 | 6/2001 | Davidson et al. | 166/249 |
| 6,250,386 | B1 | 6/2001 | Ellingsen | 166/249 |
| 6,390,191 | B1 | 5/2002 | Melson et al. | 166/177.1 |
| 6,405,796 | B1 | 6/2002 | Meyer et al. | 166/249 |
| 6,405,797 | B2 | 6/2002 | Davidson et al. | 166/249 |
| 6,412,354 | B1 | 7/2002 | Birchak et al. | 73/861.356 |
| 6,427,774 | B2 | 8/2002 | Thomas et al. | 166/248 |
| 6,460,618 | B1 | 10/2002 | Braithwaite et al. | 166/249 |
| 6,467,542 | B1 | 10/2002 | Kostrov et al. | 166/249 |
| 6,619,394 | B2 | 9/2003 | Soliman et al. | 166/249 |
| 6,691,778 | B2 | 2/2004 | Cole et al. | 166/249 |
| 6,725,923 | B1 | 4/2004 | Ivannikov et al. | 166/249 |

* cited by examiner

APPARATUS AND METHOD FOR HARD ROCK SIDEWALL CORING OF A BOREHOLE

BACKGROUND

The present invention relates generally to an apparatus and method for hard rock sidewall coring of a borehole, and more particularly to a rotary sidewall coring tool that employs a direct drive mechanism, which operates at an enhanced efficiency, a coring bit control circuit, which provides for precise control of bit advancement, and a carousel core storing device that enables the storage of a large number of core samples.

Conventional tools for hard rock sidewall coring of a borehole employ complex drive mechanisms, which are not very efficient. Many of these systems also provide inadequate torque delivery at the coring bit making them incapable of delivering reliable core operation. In one such system, the drive mechanism comprises an electric motor coupled to a hydraulic pump, which in turn is coupled to a hydraulic motor, which drives the bit. There is a significant power loss in the hydraulic pump and hydraulic motor of such systems. This is because the down hole temperatures are very high, which lowers the viscosity of the hydraulic fluid in the hydraulic pump and motor, which in turn causes a significant amount of the hydraulic fluid to seep past the pistons in the hydraulic pump and motor, which results in a loss of power output by the pistons. Up to sixty percent (60%) of the efficiency of the hydraulic pump and motor can be lost through the drop in viscosity of the hydraulic fluid. Additional efficiency of such systems are lost because they employ a second hydraulic pump to drive the auxiliary devices, which is a drain on the power output of the electric motor. Thus, such systems can lose up to seventy percent (70%) of their efficiency. Hydraulic motors, therefore, have losses due to low volumetric efficiency (fluid loss) and mechanical efficiency (losses due to gears and bearings) which make their overall efficient less than ideal.

In another conventional system, the drive mechanism comprises an electric motor coupled to a hydraulic pump, which is in turn coupled to a hydraulic motor in turn coupled to a 90° transmission. This system has the same drawbacks of the previously described system, namely that there are significant loses due to the decrease in viscosity of the hydraulic fluid in the hydraulic motor. The drive mechanism in this system outputs a low speed and high torque to the bit. Because of its slow speed, this system takes longer than the other systems to remove each core sample. Thus, it requires more rig operation time, thereby making it more expensive to employ.

Furthermore, conventional tools for hard rock sidewall coring of a borehole employ limited feedback of operating conditions. While such devices have the ability to control the advancement of the core bit during coring, they do not have the ability to monitor in real time the torque of the bit. Since torque is a primary factor in determining the rate of penetration of the bit, conventional coring devices lack an important piece of information to prevent stalling of the bit during the coring operation. Rather, such devices infer the torque or RPM from the pressure response or motor current changes during the coring operation. However, because inferential readings are inherently inaccurate, conventional coring devices are susceptible to stalling.

Another disadvantage of conventional tools for hard rock sidewall coring of a borehole is that they have limited space in which to store the core samples. Accordingly, only a limited number of samples can be stored in such devices during a single run of the tool. In certain wells, therefore, the tool must be run down hole more than once to collect all of the desired core samples. A tool with larger core sample storage capacity is desirable.

SUMMARY

The features and advantages of the present invention will be readily apparent to those skilled in the art upon a reading of the description of the exemplary embodiments, which follows.

In one embodiment, the present invention is directed to a rotary sidewall coring tool. The coring tool comprises a drive motor, e.g., an electric motor or hydraulic motor, a flexible drive shaft coupled to the drive motor and a coring bit assembly coupled to the flexible drive shaft, such that the coring bit is directly driven by the drive motor. The coring tool further comprises a clutch, which couples the drive motor to the flexible drive shaft and a gear assembly, which couples the clutch to the flexible drive shaft. As used herein, the terms "couple," "couples," "coupled" or the like, are intended to mean either indirect or direct connection. Thus, if a first device "couples" to a second device, that connection may be through a direct connection or through an indirect connection via other devices or connectors. The coring tool according to present invention further comprises a hydraulic pump coupled to the drive motor, which drives auxiliary devices. The coring tool also comprises a bit control circuit and sensor, which controls advancement of the coring bit and measures the rpm of the flexible drive shaft, respectively.

The coring bit is mounted on a platform, which is part of the coring bit assembly. The coring bit assembly includes a gear assembly described below. The coring bit assembly can move from a vertical storage position to a horizontal operable position by a hydraulic piston and lever arms. The hydraulic piston is powered by a hydraulic pump, which is in turn driven by the drive motor.

The hydraulic piston also manipulates the coring tool to deposit coring samples into a rotating carousel, which is also powered by the hydraulic pump and ultimately the electric motor. The coring tool further comprises a core separator disposed adjacent to the rotating carousel, which comprises a plurality of labeled discs that identify each core sample collected and a spring loaded plunger that dispenses a labeled disc with each core sample loaded into the rotating carousel. The coring tool also comprises a pair of back-up pistons disposed within the tool, one of which is disposed above the coring bit assembly and the other of which is disposed below the coring bit assembly, which upon activation thrust the tool against one side of the well bore just prior to the coring operation. The coring tool further comprises a potentiometer for measuring the length of the core sample.

In another embodiment, the present invention is directed to a method of coring a borehole in a hard rock subterranean formation. The method comprises the steps of activating the drive motor to rotate an output shaft; coupling the output shaft of the drive motor to the flexible drive shaft; and rotating the coring bit with the flexible drive shaft. Other steps of the method include rotating the coring bit from the vertical storage position to the horizontal operable position; advancing the coring bit laterally into the hard rock subterranean formation; reducing the rotational speed being transmitted to the flexible drive shaft by the output shaft of the drive motor. Other steps in accordance with the present invention include driving auxiliary devices with a hydraulic pump driven by the drive motor and providing feedback signals to the bit control circuit, which are indicative of the rpm and torque of the coring bit and lateral advancement of the coring bit. Still further steps include discharging a core sample from the coring bit, measuring the length of the core sample, depositing the core sample into the rotating carousel; dispensing a labeled disc into the rotating carousel; and thrusting the coring bit against one side of a well bore just prior to commencing the coring operation.

The features and advantages of the present invention will be readily apparent to those skilled in the art upon a reading of the description of the embodiment that follows.

DRAWINGS

The following figures form part of the present specification and are included to further demonstrate certain aspects of the present invention. The invention may be better understood by reference to one or more of these drawings in combination with the description of the embodiments present herein:

DETAILED DESCRIPTION

Figure 1:
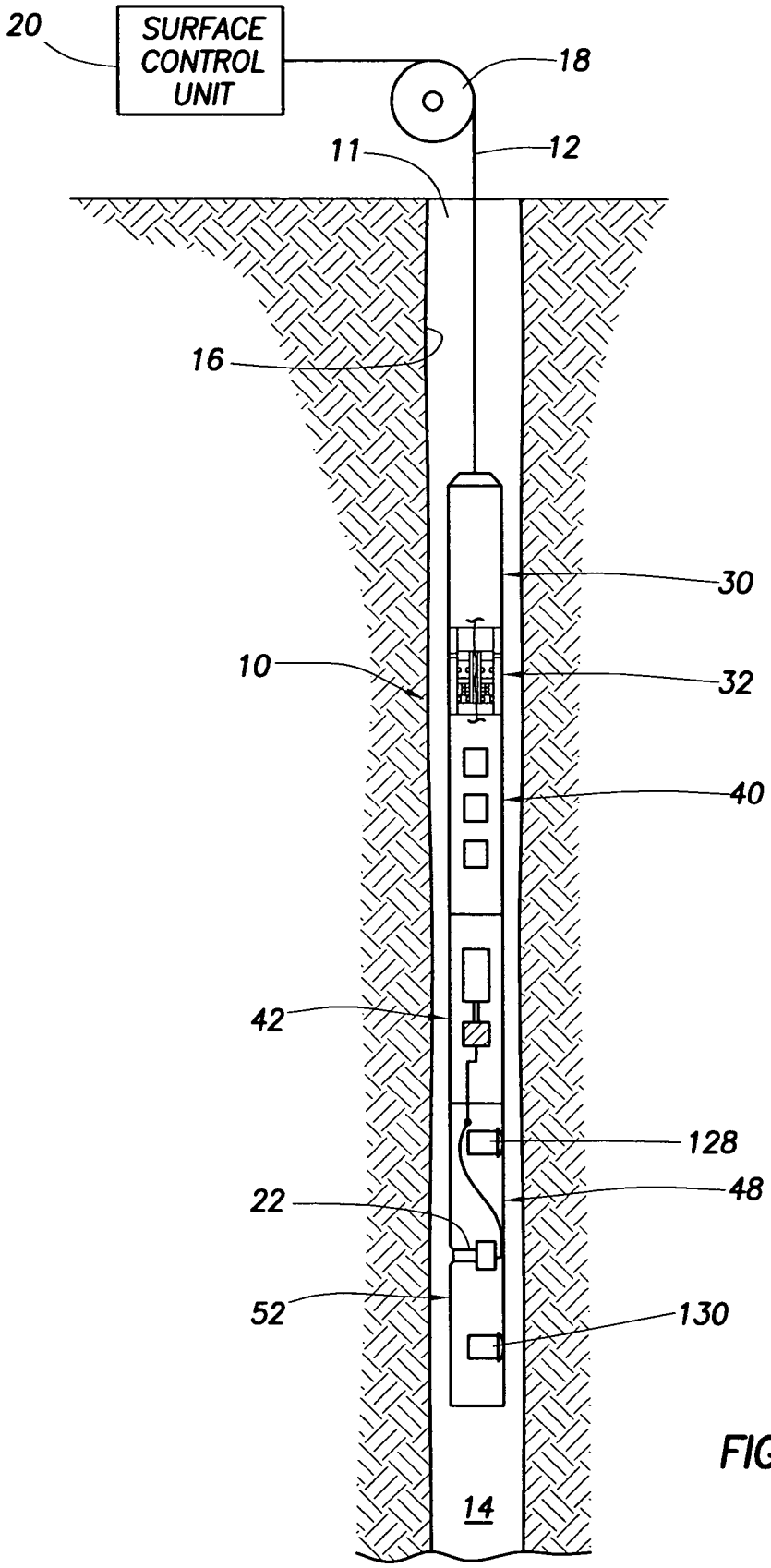
FIG. 1 is a schematic diagram illustrating a rotary sidewall coring tool in a well bore with a coring bit retracted.

The details of the present invention will now be described with reference to the accompanying drawings. Turning to FIG. 1, a rotary coring tool in accordance with the present invention is shown generally by reference numeral 10. The coring tool 10 is suspended by wire line 12 in a well bore 14 defined by sidewall 16. Wire line 12 engages a sheave 18 associated with a surface control unit 20. The surface control unit 20 includes processing means for programming and controlling various functions of the coring tool 10. The electronic signals are transmitted through wire line 12, which can serve both as a conductor and a stress member. This process of communicating, programming and controlling data via a wire line is well known in the art.

Figure 2:
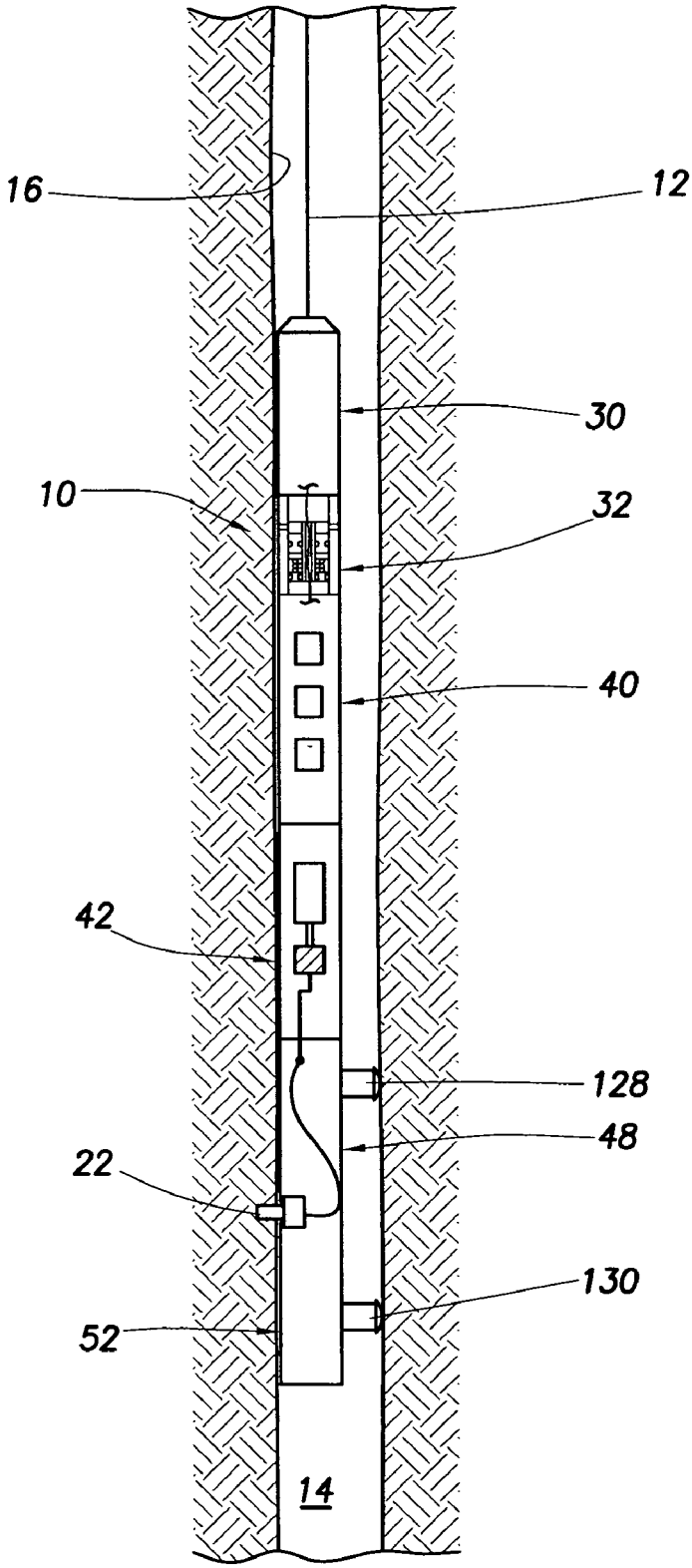
FIG. 2 illustrates the coring tool of FIG. 1 with the tool locked in place and with a coring bit extended.
Figure 3A:
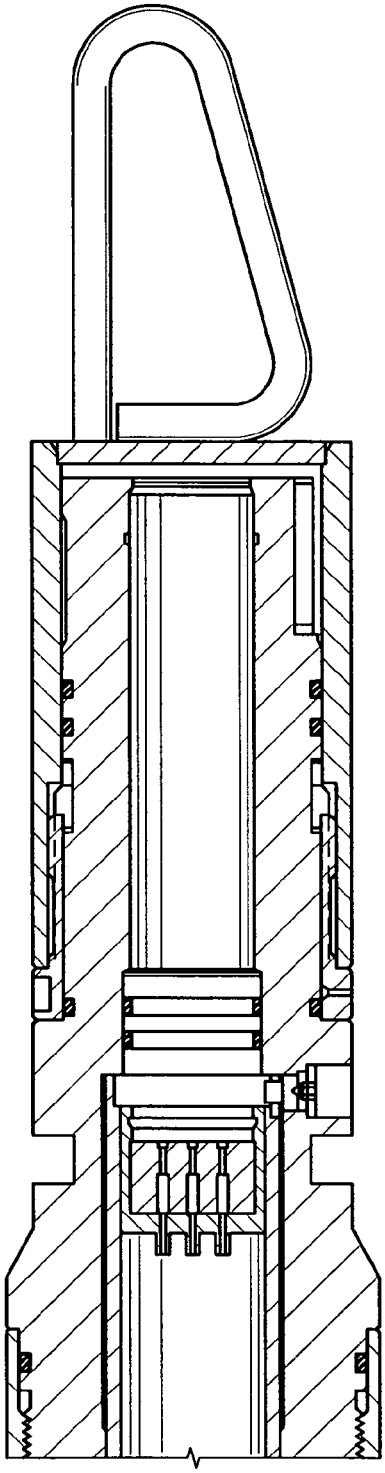
FIGS. 3A-3M illustrate sections of a longitudinal cross-sectional view of the coring tool in accordance with the present invention illustrating schematically each of the functional sections of the tool.
Figure 3B:
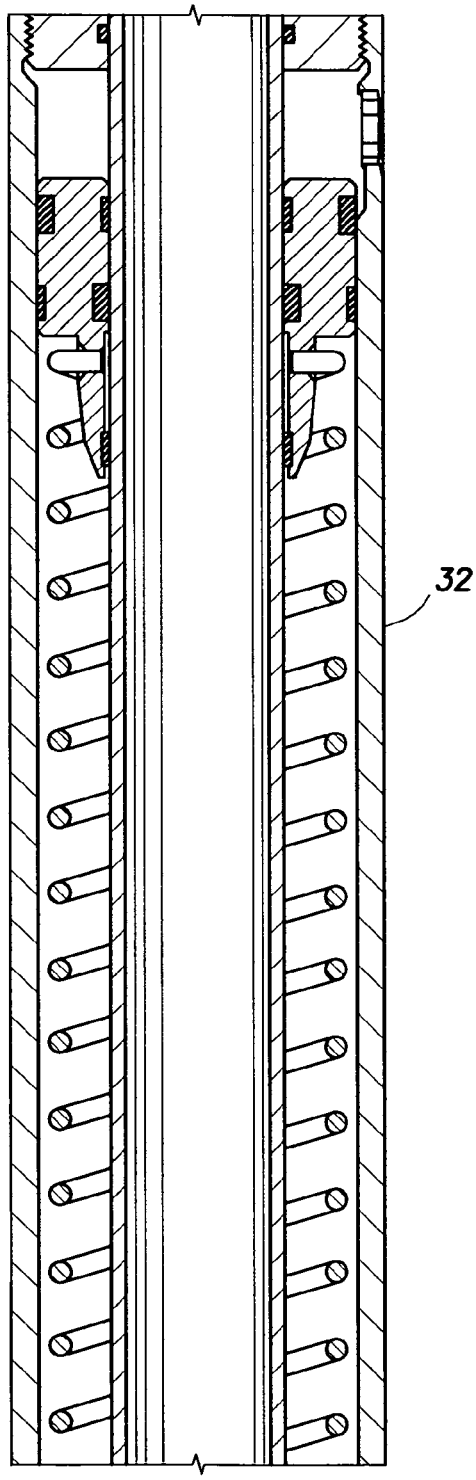
Figure 3C:
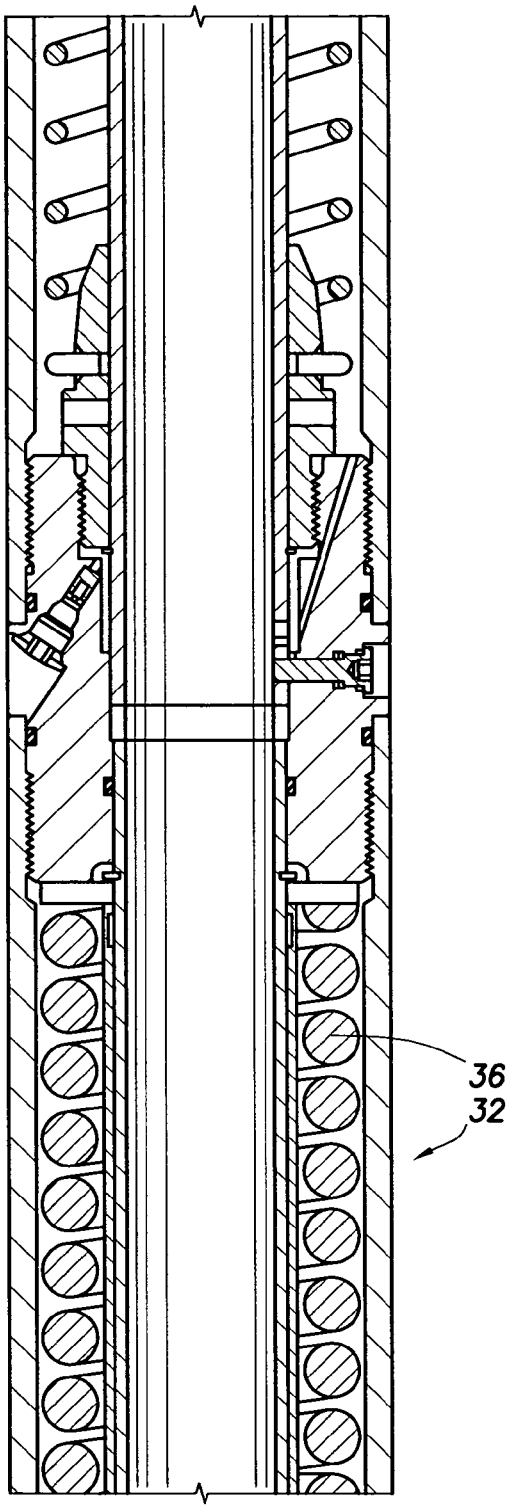
Figure 3D:
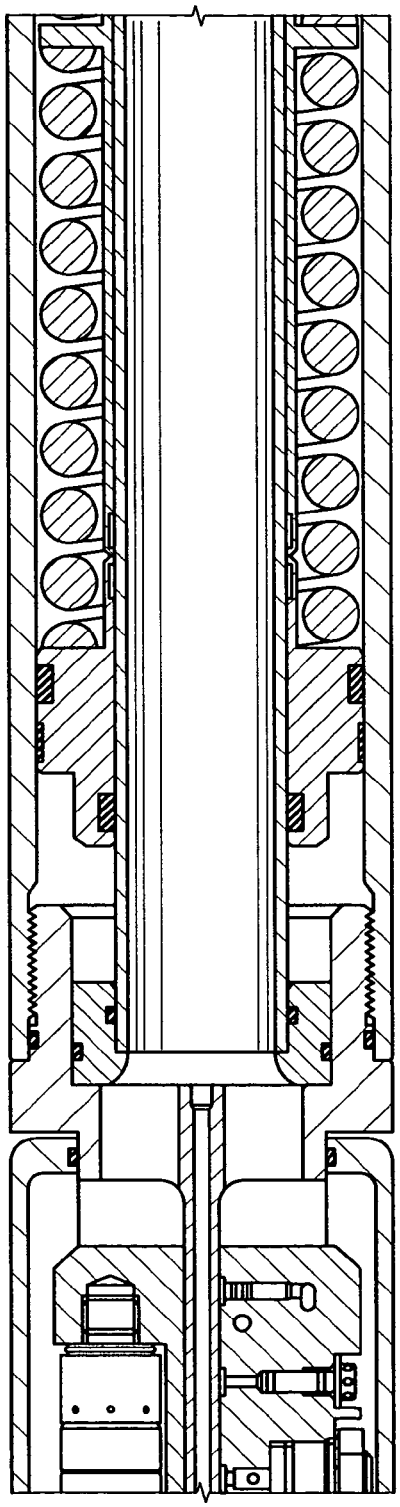
Figure 3E:
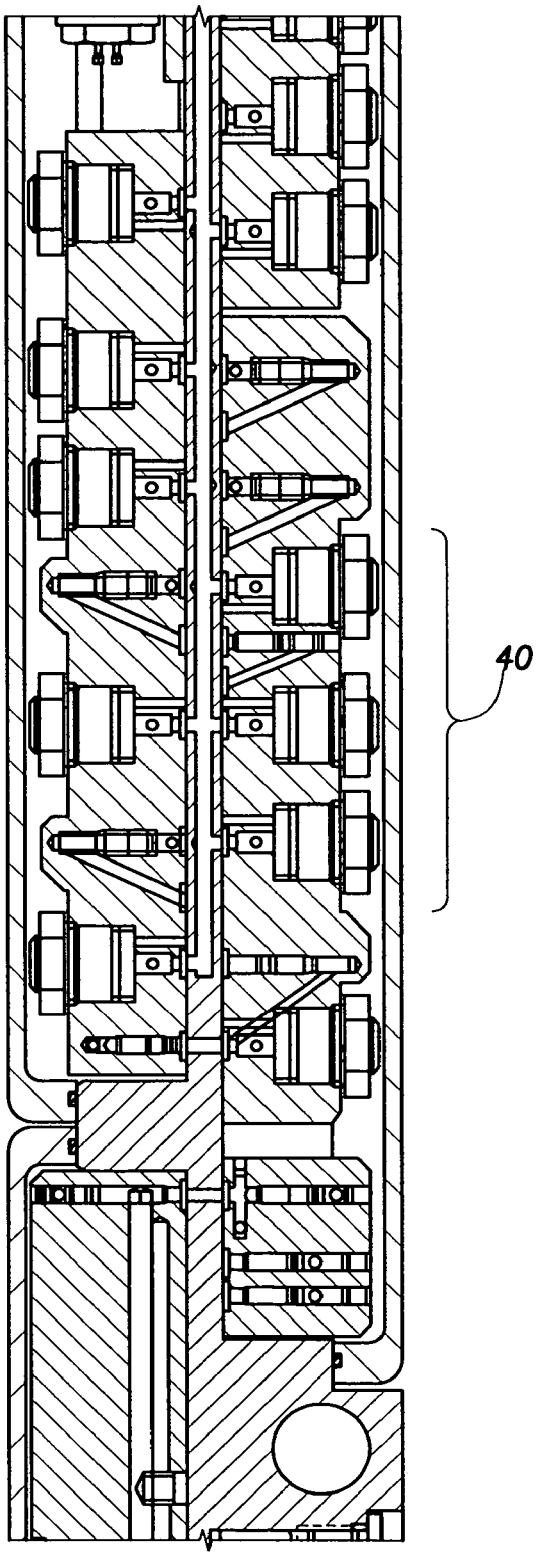
Figure 3F:
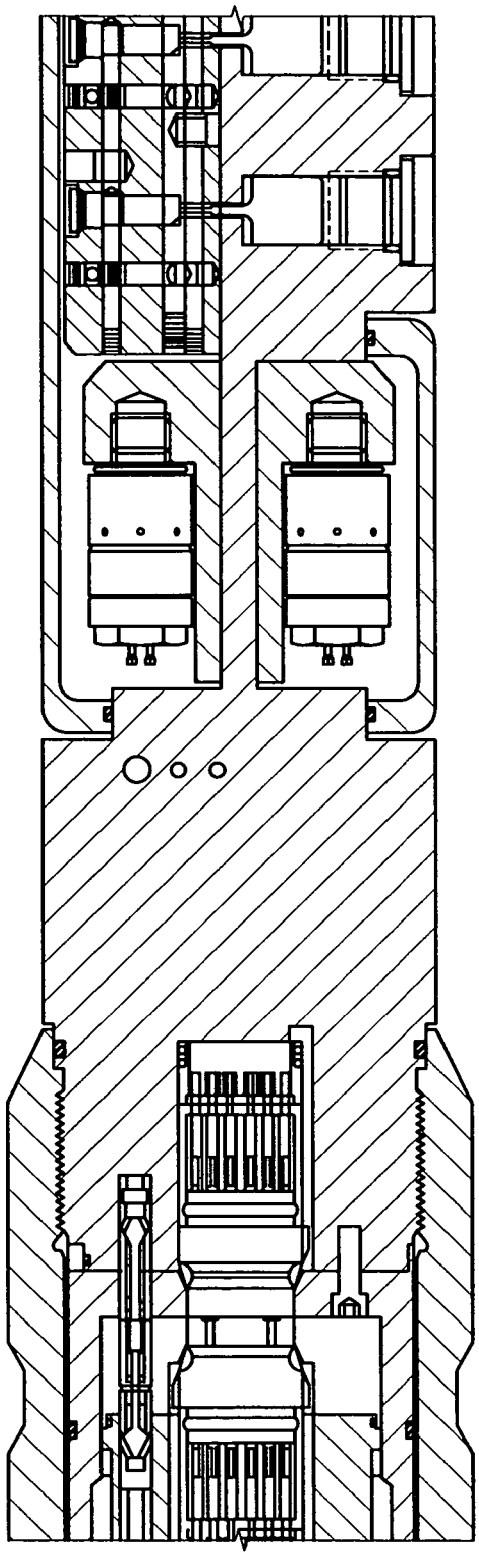
Figure 3G:
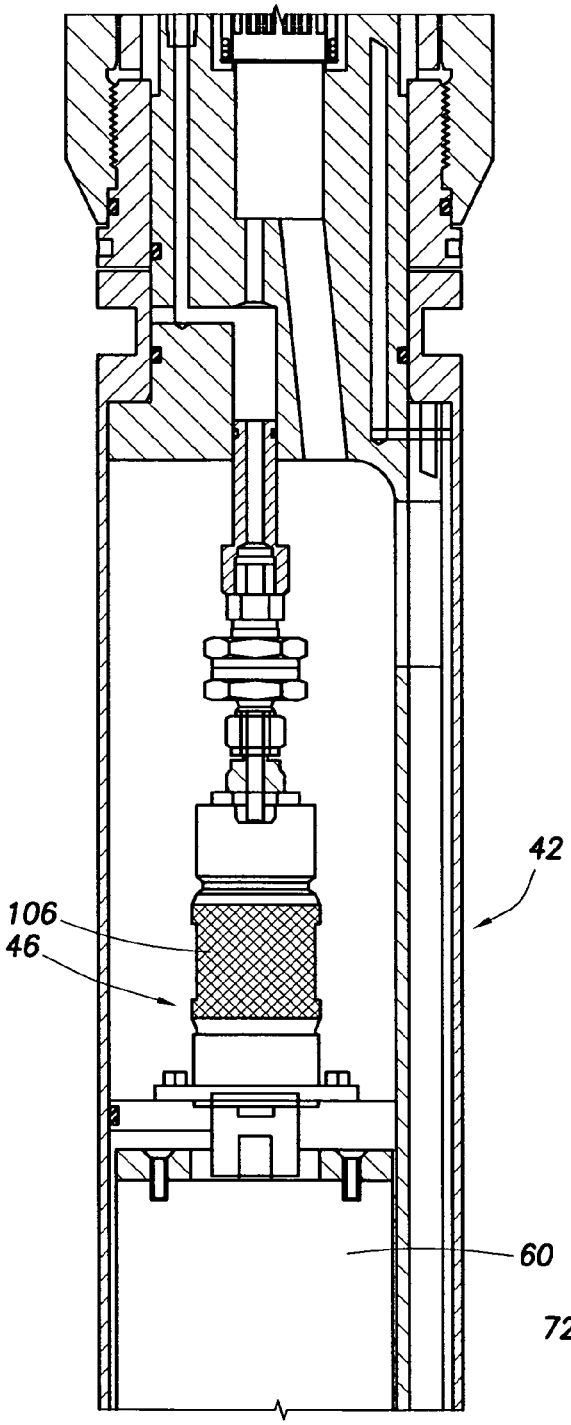

The coring tool 10 includes a coring bit 22, which is shown in FIG. 1 in a retracted position. Coring tool 10 further comprises a pair of back-up pistons 128 and 130, which in the extended position, as shown in FIG. 2, lock the tool against the sidewall 16 of well bore 14. The coring tool 10 may also include a dedicated section 30 in which the tool's on-board electronics and telemetry system is housed. Section 32 houses a pressure compensator, whose function is to equalize the internal pressure to the external well bore pressure. Section 32 also houses an accumulator 36 (shown in FIG. 3C). The accumulator 36 accumulates hydraulic fluid for uses requiring an immediate hydraulic boost to close all the extended functions of the tool while coring, e.g., bit retract, bit tilting and back-up retract in case of electronic power loss. Section 40 houses a hydraulic control circuit, shown in more detail in FIG. 3E. The hydraulic control circuit is a complex network of hydraulic flow lines and valves used to control the operation of all of the control mechanisms in the tool 10 operating off of hydraulic power. These devices are described in somewhat more detail below but are well known to those of ordinary skill in the art. Section 42 houses the power unit 46, which powers the auxiliary devices, such as the pistons, which control movement of the coring bit 22, described below, and other control devices. The power unit 46 is shown in greater detail in FIGS. 3G and described more fully below. Section 48 contains the coring bit assembly 50 (shown in FIG. 5) and section 52 houses the core storage device, namely rotatable carousel 54, as described in further detail below.

FIG. 2 shows the coring tool 10 locked in position opposite the subterranean formation of interest. The coring bit 22 is shown extended laterally through a bit opening in the side of the coring tool 10 cutting a core sample in the formation of interest.

Figure 3H:
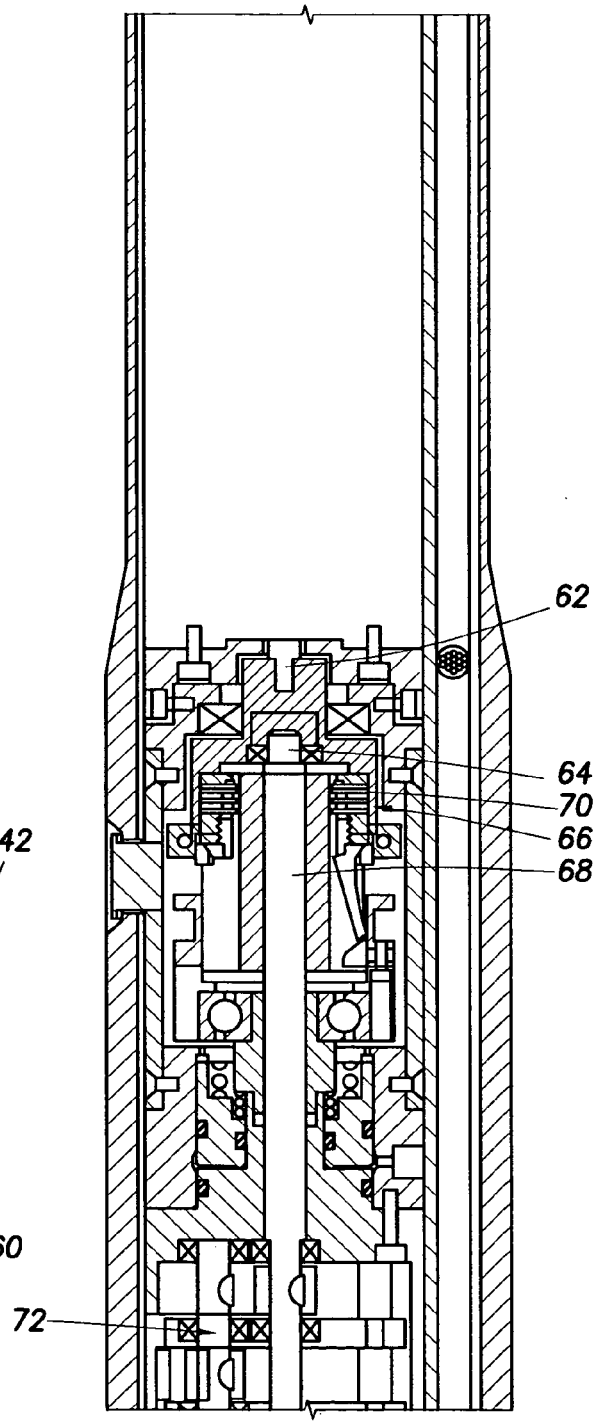
Figure 3I:
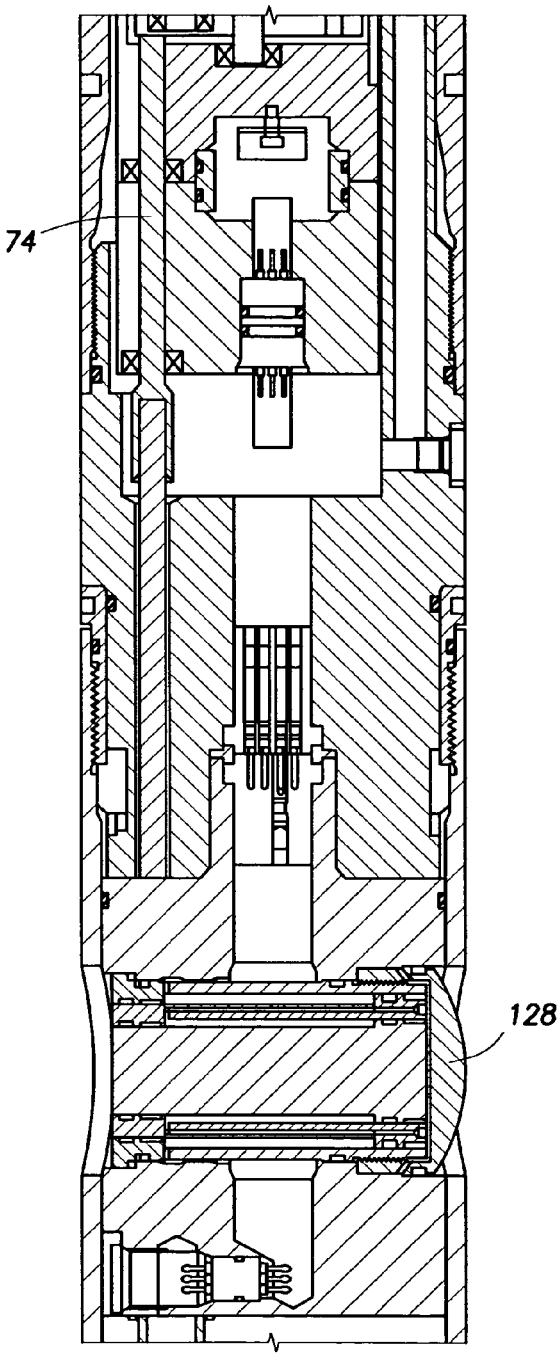
Figure 3J:
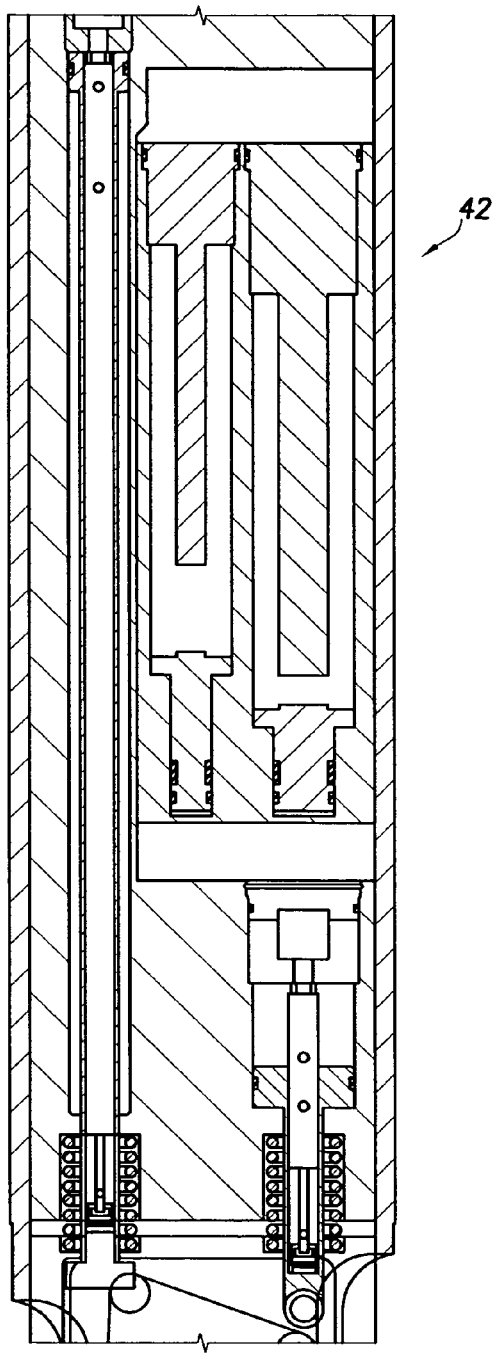
Figure 3K:
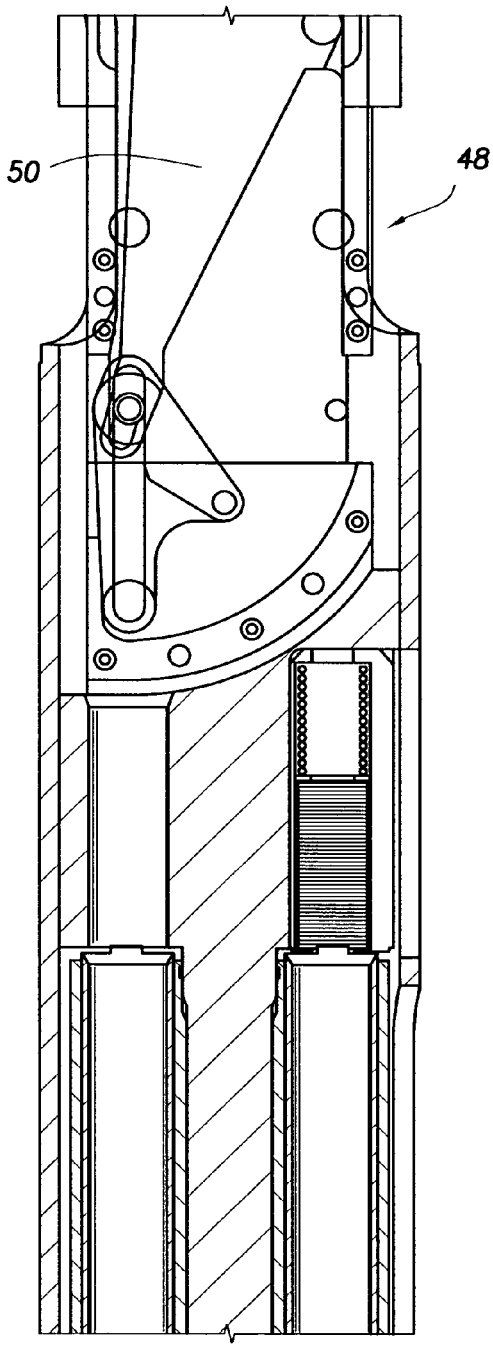
Figure 3L:
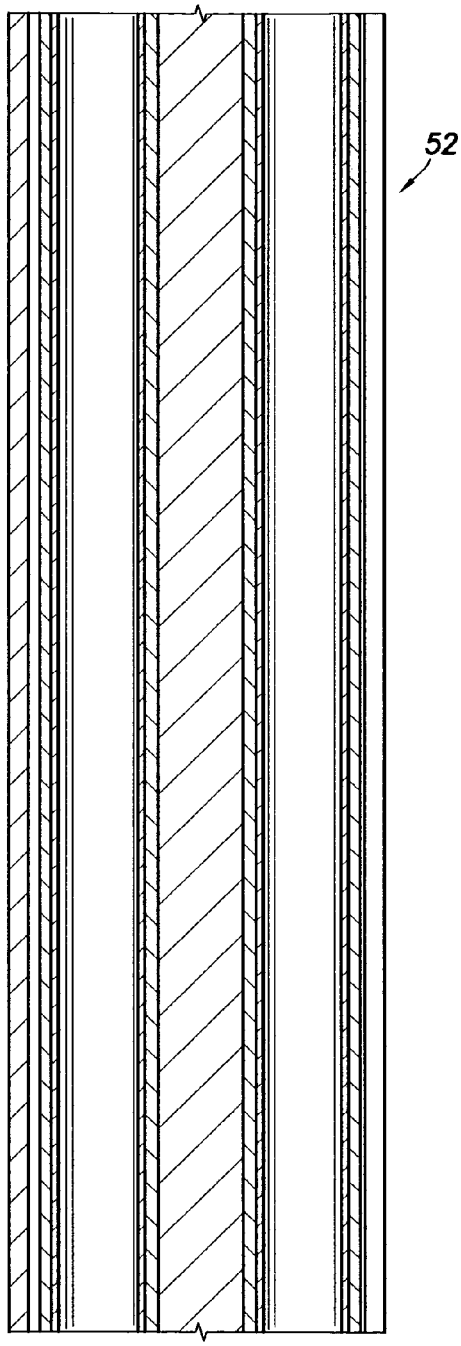
Figure 3M:
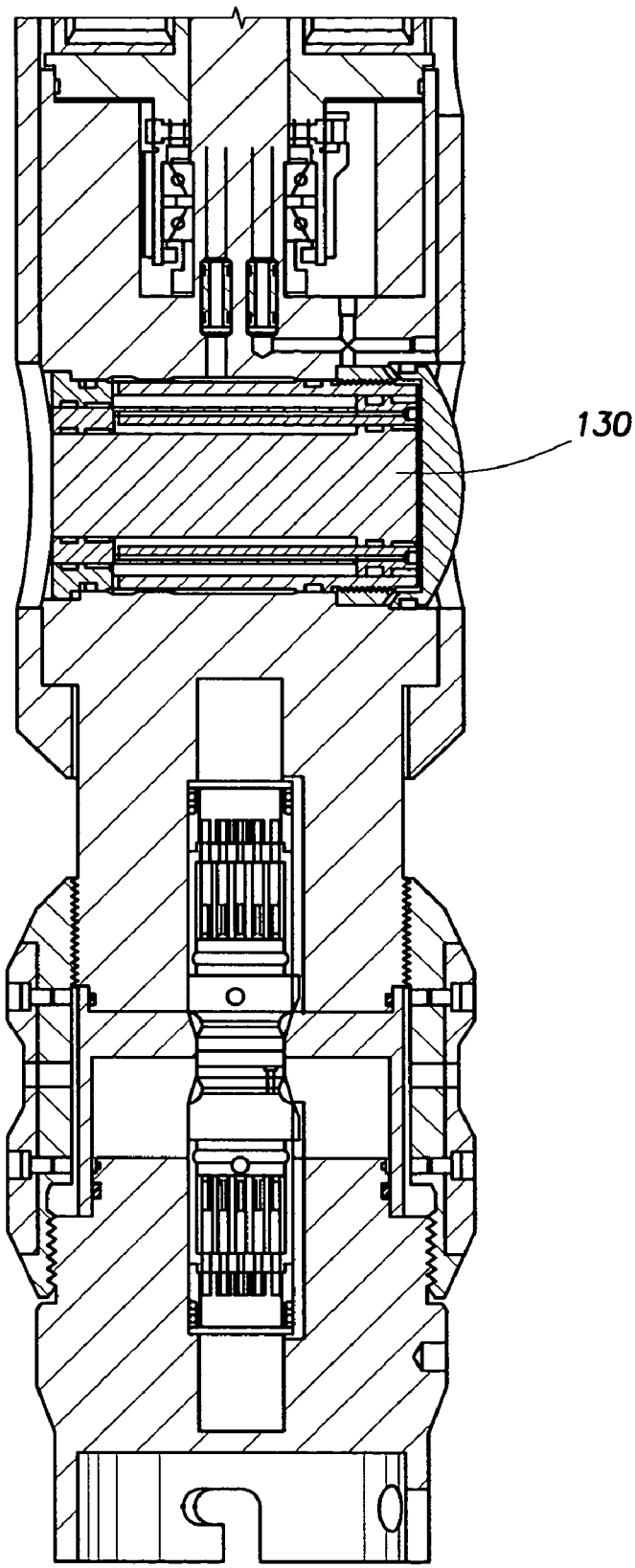
Figure 4A:
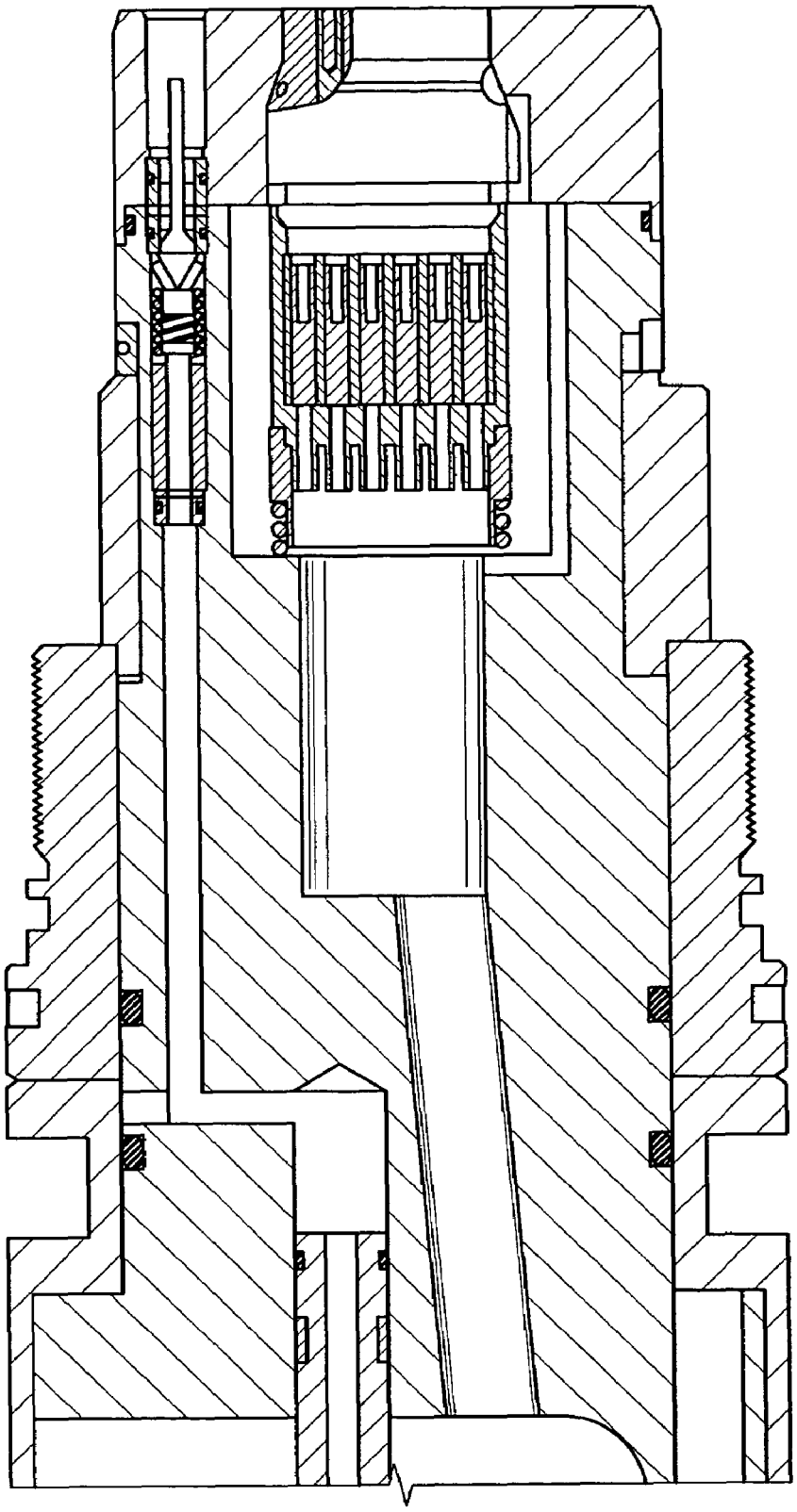
FIGS. 4A-4G illustrate sections of an enlarged longitudinal cross-sectional views of the coring tool with a focus on the clutch and torque sensor portions of the tool in accordance with the present invention.
Figure 4B:
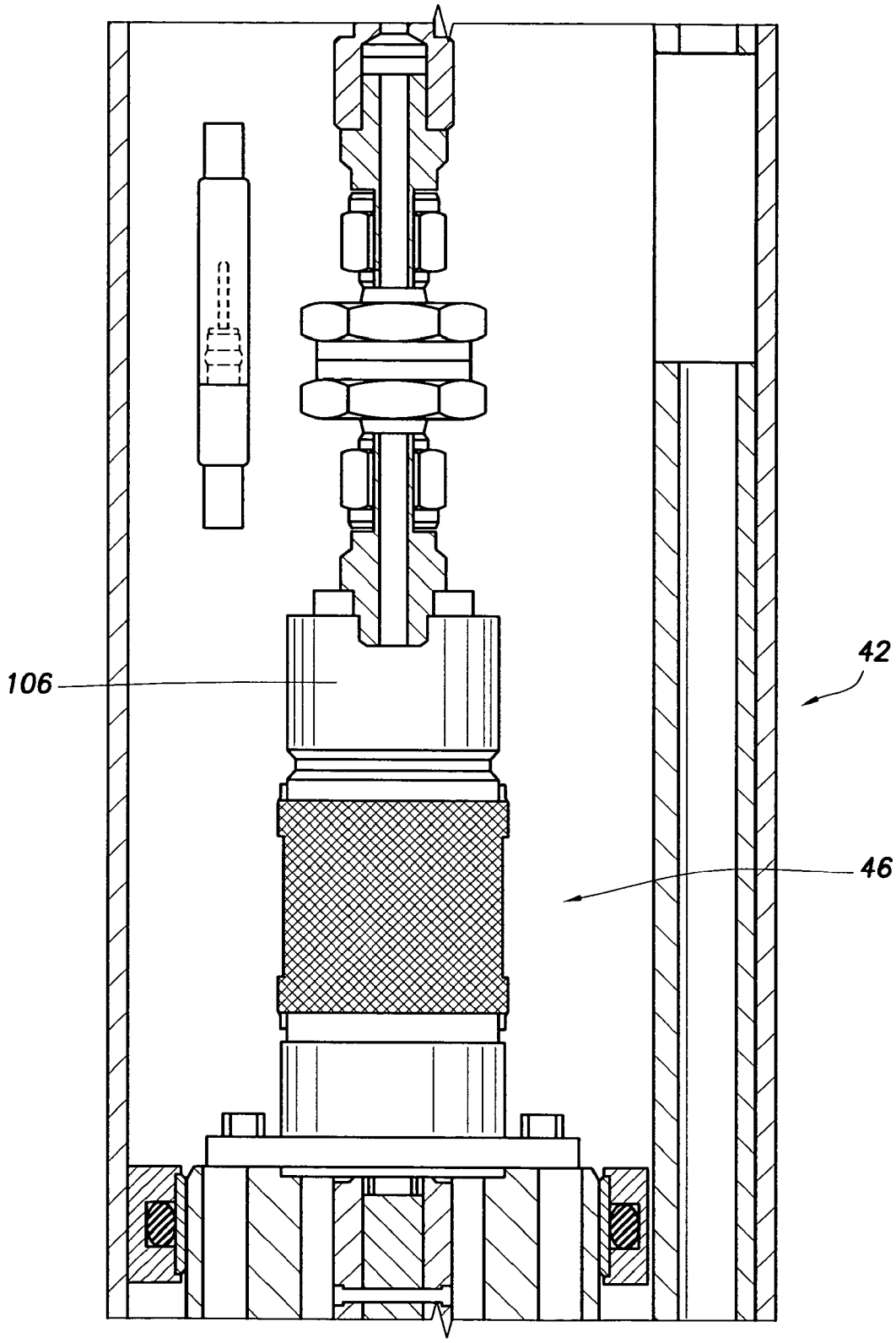
Figure 4C:
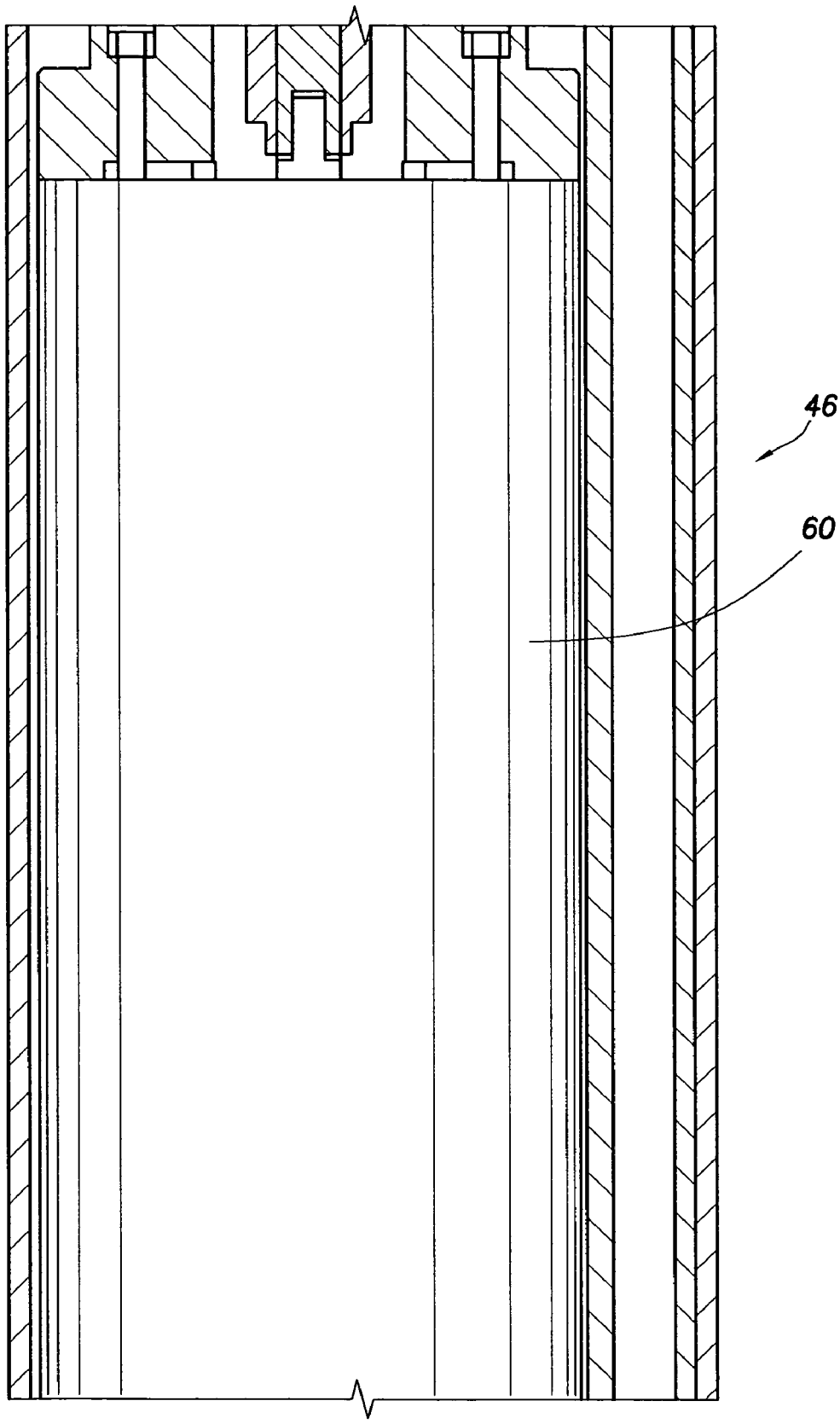
Figure 4D:
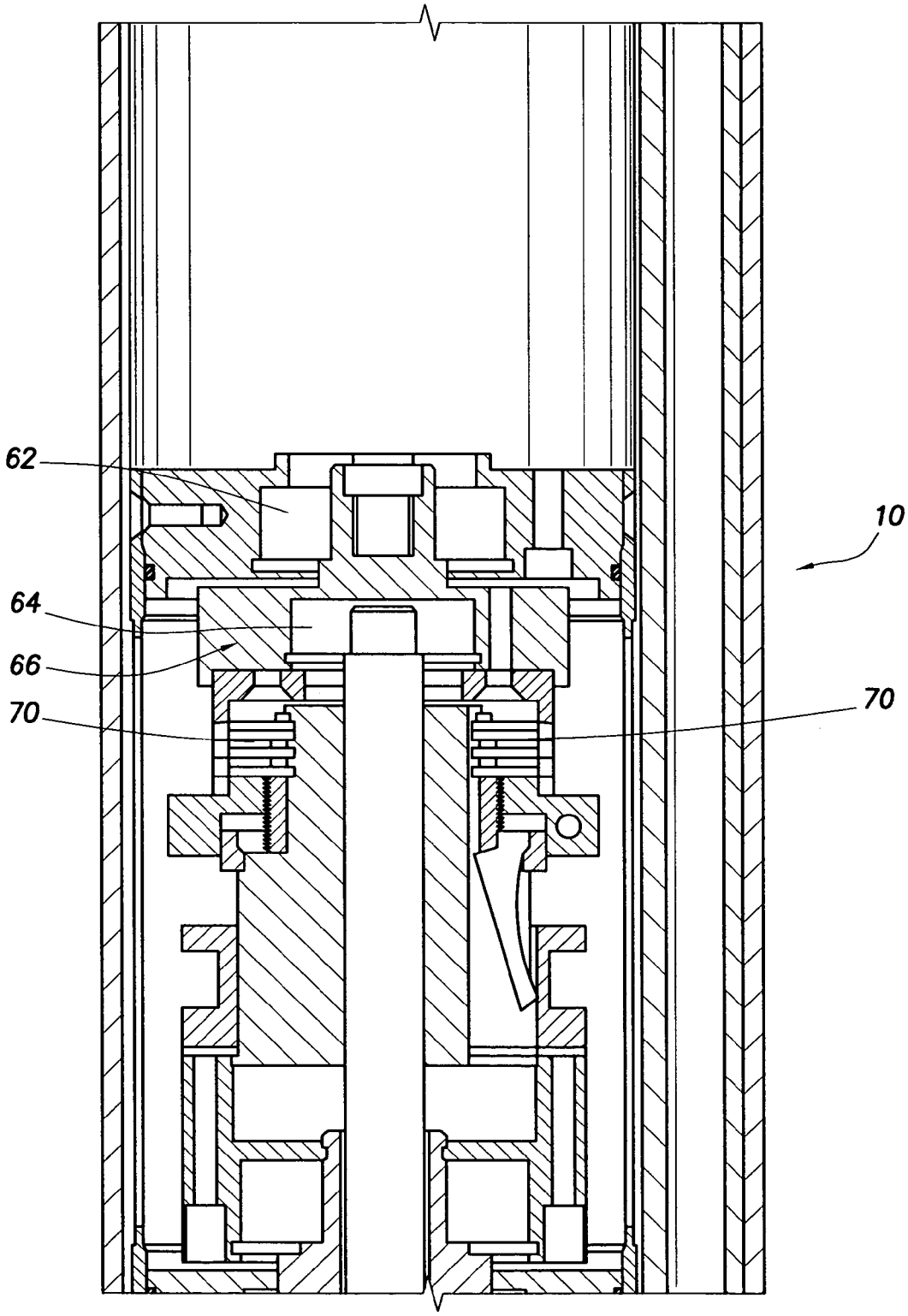
Figure 4E:
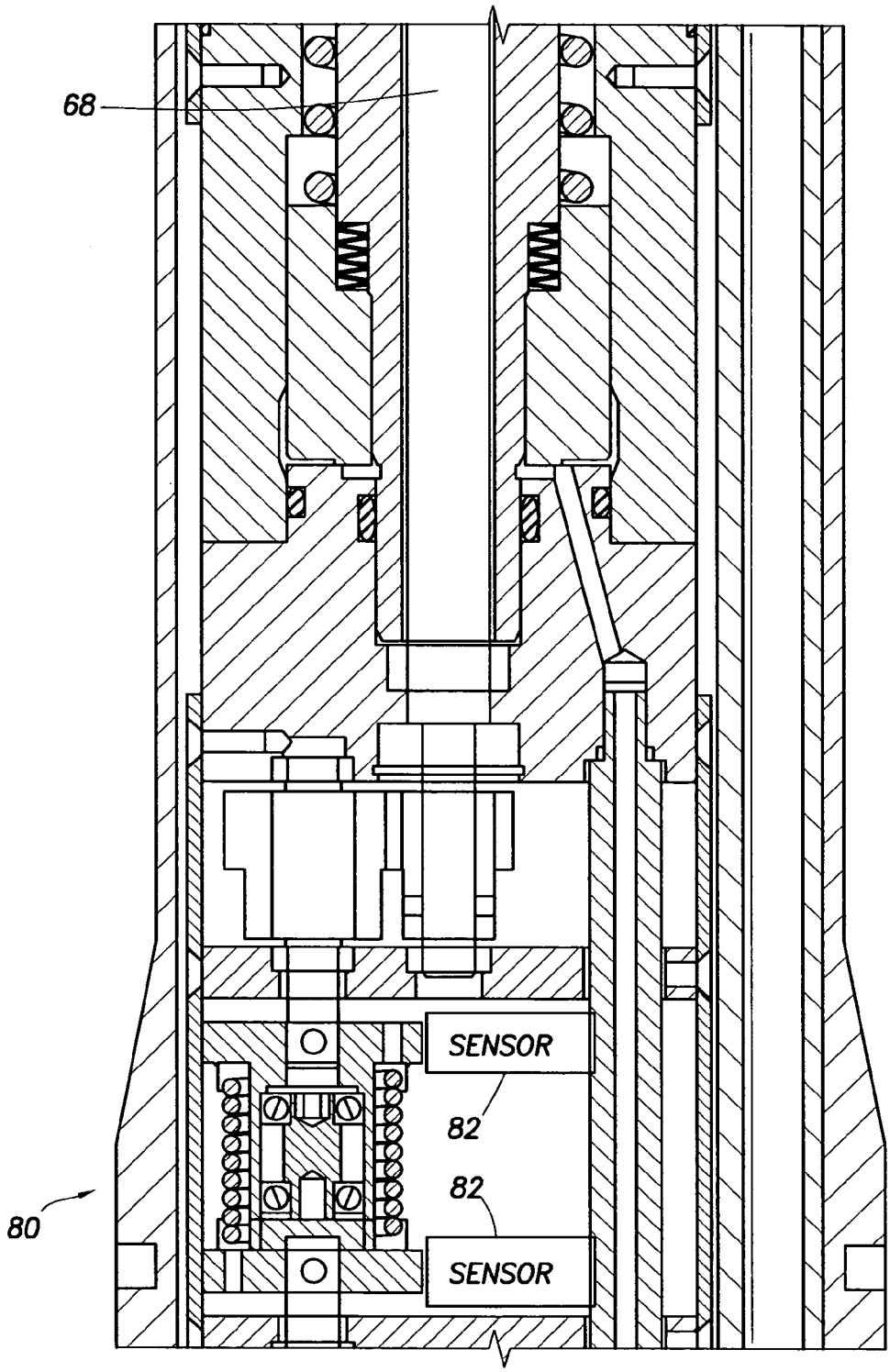
Figure 4F:
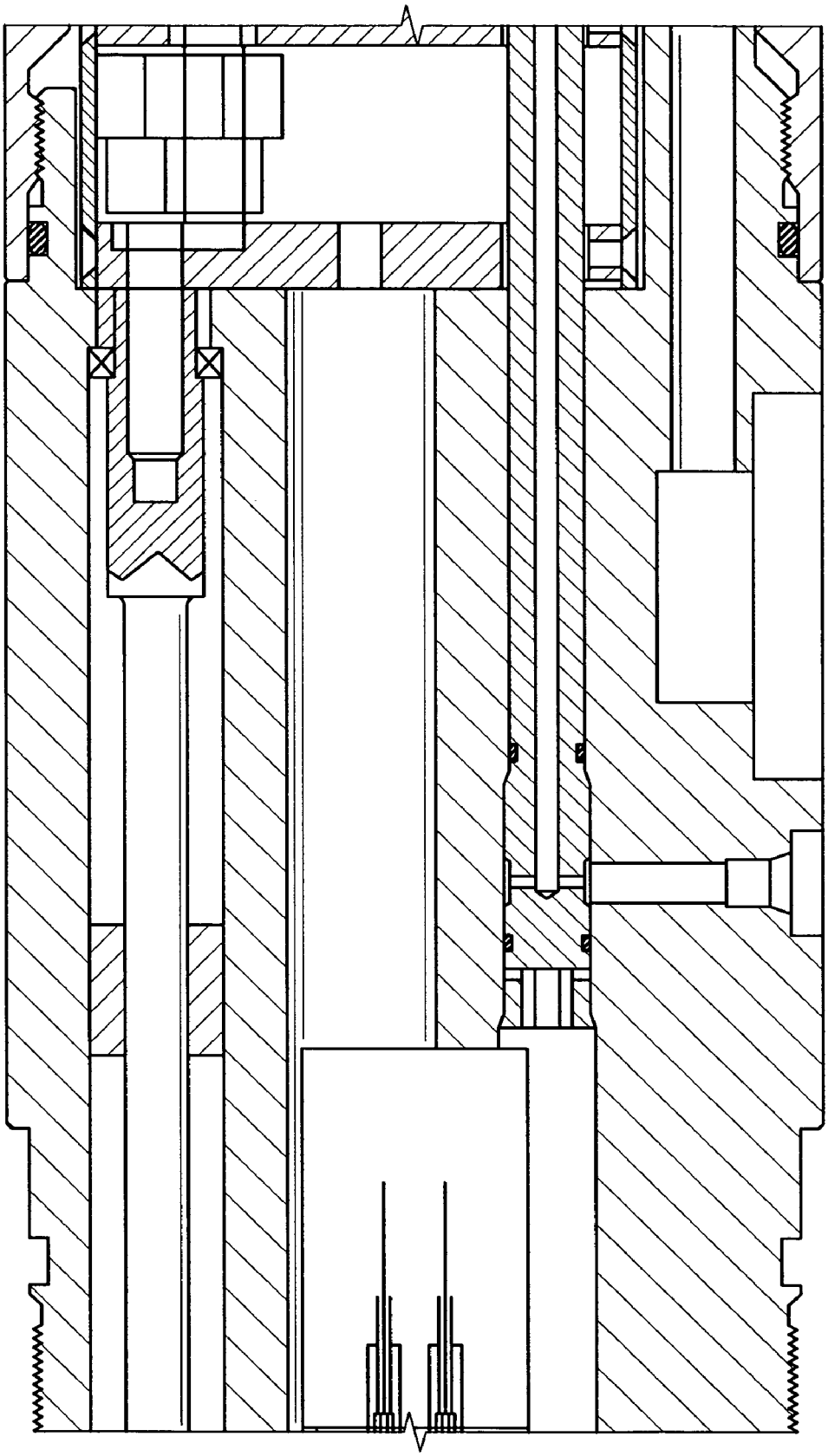
Figure 4G:
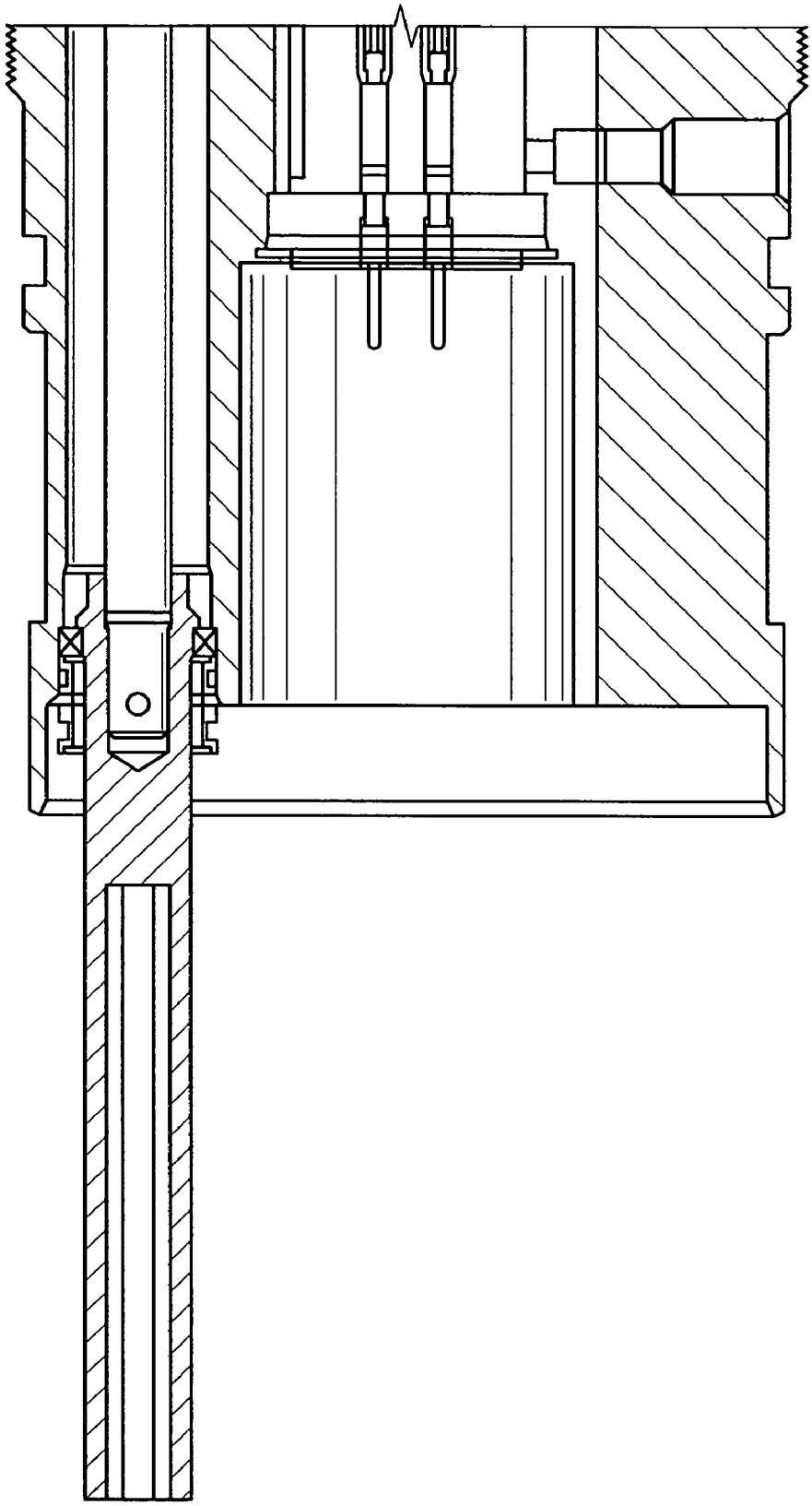

Additional details of the coring tool 10 in accordance with the present invention will now be described in connection with FIGS. 3 through 8. Referring to FIGS. 3G, 3H, 4C and 4D, the details of the power unit 46 will now be described. The power unit 46 comprises a drive motor 60, which in this example is a one horsepower (1 hp) AC electric motor, which receives voltage through wire line 12. Drive motor 60 has an output shaft 62 which rotates at 3,000 rpm during operation. Output shaft 62 of the drive motor 60 is coupled to an input shaft 64 of clutch 66. Input shaft 64 of clutch 66 is coupled to main shaft 68 of clutch 66 via a plurality of clutch plates 70. As those of ordinary skill in the art will appreciate, when the clutch plates 70 are engaged the input shaft 64 of clutch 66 drives main shaft 68, as shown in FIGS. 3H and 4D. When the clutch plates 70 are disengaged, the main shaft 68 is disengaged from input shaft 64, and is thereby stationary. The clutch plates 70 are brought into engagement and disengagement by a piston-energized electrically controlled valve controlled by the tool's electronic control system. It should be noted and appreciated that some of the tool's electronic control will occur at the surface control unit 20 another and other electronic control may occur in the tool's on-board electronics control device in section 30. The pressure is provided to the valve from the hydraulic pump 106, ultimately driven by the drive motor 60. Those of ordinary skill in the art will understand how the engaging device works and therefore the details of such device will not be described in any greater detail herein.

A gear assembly 72 is coupled to main shaft 68, as shown in FIGS. 3H and 4D. The gear assembly 72 comprises a plurality of intermeshing gears, which decrease the rotational speed of the drive mechanism imparted by main shaft 68 and axially offset the drive output of main shaft 68. Gear assembly 72 has an output shaft 74 (shown in FIG. 3I) which rotates at approximately 2,100 rpm and has a power output of approximately 0.7 horsepower. Thus, the gear assembly 72 imposes a speed reduction of approximately 1.6:1.0. Alternatively, the gear assembly 72 only axially offsets the drive output of the main shaft 68 without reducing its rotational output to the flexible drive shaft 76.

Figure 13A:
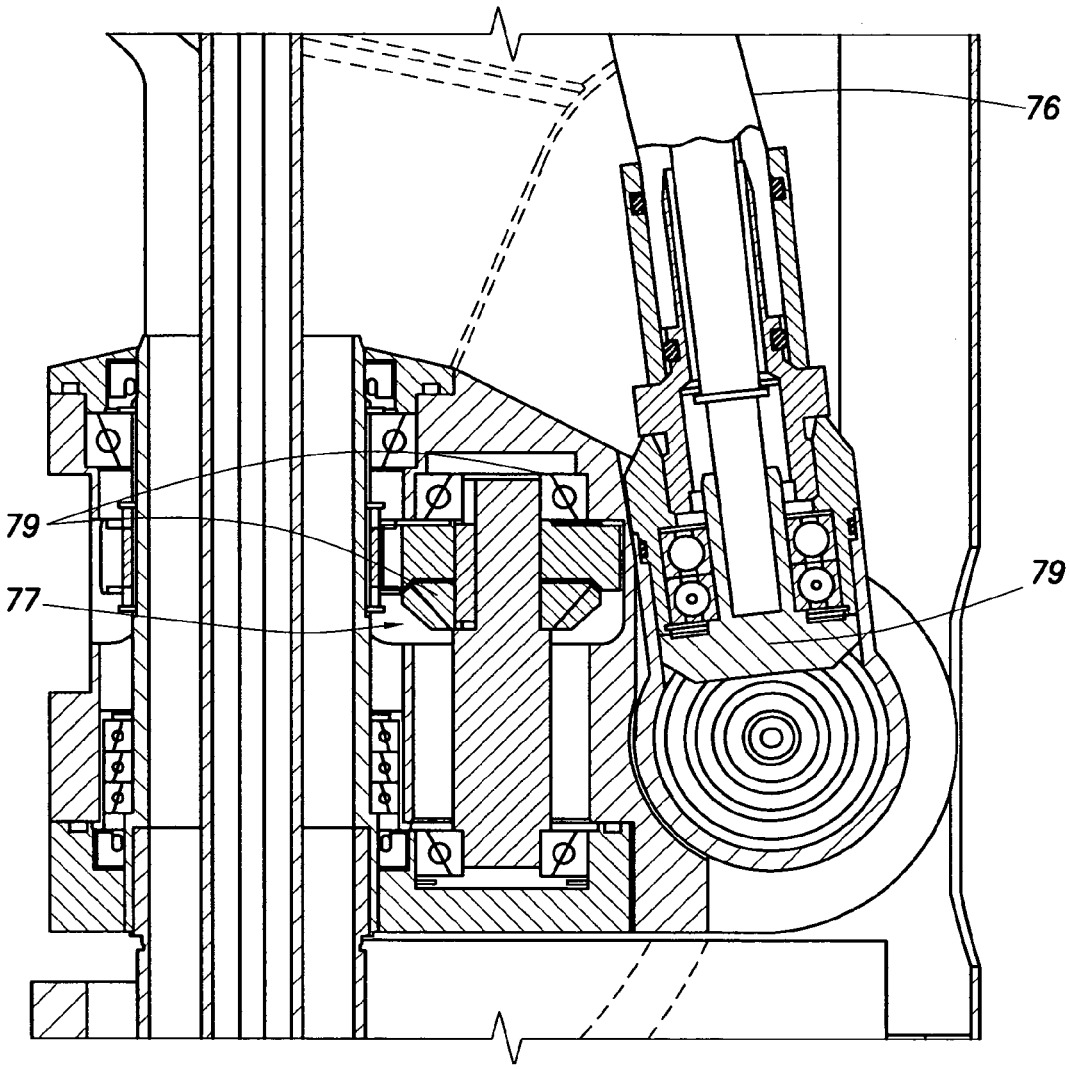
FIG. 13A is a partial cross-sectional view of the coring tool illustrating the gear assembly in the coring bit assembly that translates rotation of the flexible drive shaft into rotation of the coring bit.

The output shaft 74 of the gear assembly 72 is coupled to a flexible drive shaft 76, best shown in FIG. 13A. Flexible draft shaft 76 is any drive shaft, which is capable of transmitting rotational motion and is flexible enough to bend during rotation. In one embodiment, the flexible drive shaft 76 is formed of a metal probe disposed within a Teflon tube. An example of such a flexible drive shaft is the odometer cables that are typically used in automobiles. The flexible drive shaft 76 connects at its other end to a gear assembly 77 (shown in FIG. 13A) in the coring bit assembly 50. The gear assembly 77 comprises a plurality of intermeshing bevel gears 79, which are configured to rotate the coring bit 22 so long as the clutch plates 70 are engaged. In other words, the coring bit 22 is capable of rotating both in the vertical storage position as well as in the horizontal coring position. The gear assembly 77 imposes a 1.6:1.0 reduction in the rotational speed of the drive assembly, which translates into a rotational speed of the coring bit 22 of approximately 1450 rpm. Furthermore, the connection between the flexible drive shaft 76 and the gear assembly 77 is hinged and as such it allows relative angular movement between the axes of the flexible drive shaft 76 and the axes of the coring bit 22 while still allowing the transmission of rotational power through the hinge point.

Referring to FIG. 4, the details of a torque sensor 80 in accordance with the present invention will now be described. Torque sensor 80 is defined by a pair of reluctance sensors 82 connected to a fixed member a certain distance apart from one another, as shown in FIG. 4E. Each reluctance sensor 82 is made from a magnet, a pole piece and a coil. A magnetic field extends from the magnet through the pole piece into the air space at the end of sensor. As the magnetic tooth approaches the pole piece, the magnetic field decreases and then increases as the object moves away from the pole piece. This decrease/increase in the magnetic field induces an AC voltage signal in the coil. The induced AC voltage is in the shape of a sine wave. One sensor determines the rpm of the shaft. The phase difference between the two sensors can be used to determine the twist or torque generated by the output shaft. In other words, the generated frequency signal is directly proportional to the number of ferrous objects passing the pole piece per unit of time.

Figure 5:
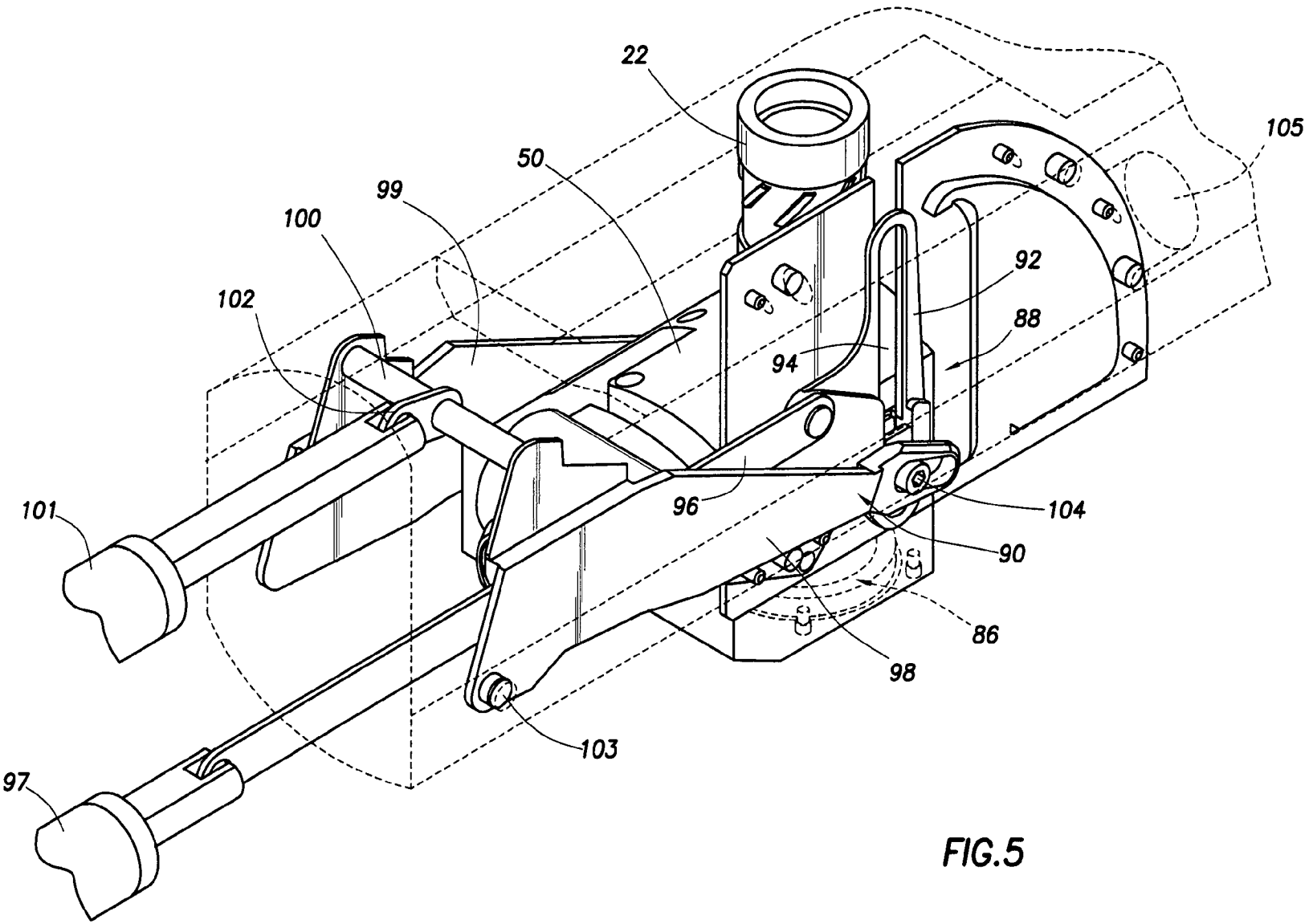
FIG. 5 is a perspective view of the coring bit and associated coring bit assembly in accordance with the present invention.

The details of the coring bit assembly 50 in accordance with the present invention will now be described. Coring bit assembly 50 comprises coring bit 22, which is capable of being rotated from a vertical storage position to a horizontal operable position, as shown generally in FIG. 2. As shown in FIG. 5, the coring bit 22 is in position for lateral advancement into sidewall 16 of the subterranean formation of interest. The coring bit 22 sits on a platform 86, which is raised, lowered, and rotated by a pair of linkage assemblies 88 and 90.

Linkage assembly 88 operates to tilt the platform 86 from a vertical storage position to the horizontal operable position. Linkage assembly 88 comprises a generally triangle-shaped lever arm 92. Lever arm 92 has a slot 94 formed along its base portion. Another lever arm 96 is coupled to lever arm 92. Lever arm 96 is connected to a positioning piston 97 operated by a hydraulic pump 106 (shown in FIGS. 3G and 4B) described later herein. Lever arm 96 through its back and forth movement imparted by the hydraulic pump 106 operates to rotate lever arm 92. When lever arm 96 is moved in a forward direction, lever arm 92 rotates in a clockwise direction and thereby moves the coring bit 22 from the horizontal operable position to the vertical storage position. When lever arm 96 is moved in a retracted position, it causes lever arm 92 to rotate counter-clockwise thereby moving coring bit 22 from the vertical storage position to the horizontal operable position.

Linkage assembly 90 comprises a pair of lever arms 98, 99 disposed on opposite ends of the coring bit 22. Lever arms 98, 99 are connected by connecting rod 100, which in turn has a mounting eye hook 102 for connecting to a bit advance piston 101, also driven by the hydraulic pump 106. Linkage assembly 90 further comprises guide pin 104, which attaches to coring bit assembly 50 and slides in slot 94. As lever arms 98, 99 are moved axially by the bit advance piston 101, they pivot at one end about pivot point 103 and slide at the other end along slot 94 carrying guide pin 104, which in turn forces the coring bit assembly 50 to move horizontally thereby enabling it to advance into the subterranean formation. In the vertical storage position, coring bit assembly 50 is housed in generally cylindrical recess 105. The positioning piston 97 and bit advance piston 101 are used to drive linkage assembly 88 and linkage assembly 90, respectively, are hydraulically connected to the section 40, which in turn is fed with pressurized hydraulic fluid via hydraulic pump 106, shown in FIG. 3. Hydraulic pump 106 is directly connected to, and driven by, drive motor 60, also shown in FIGS. 3G and 4B.

Figure 6:
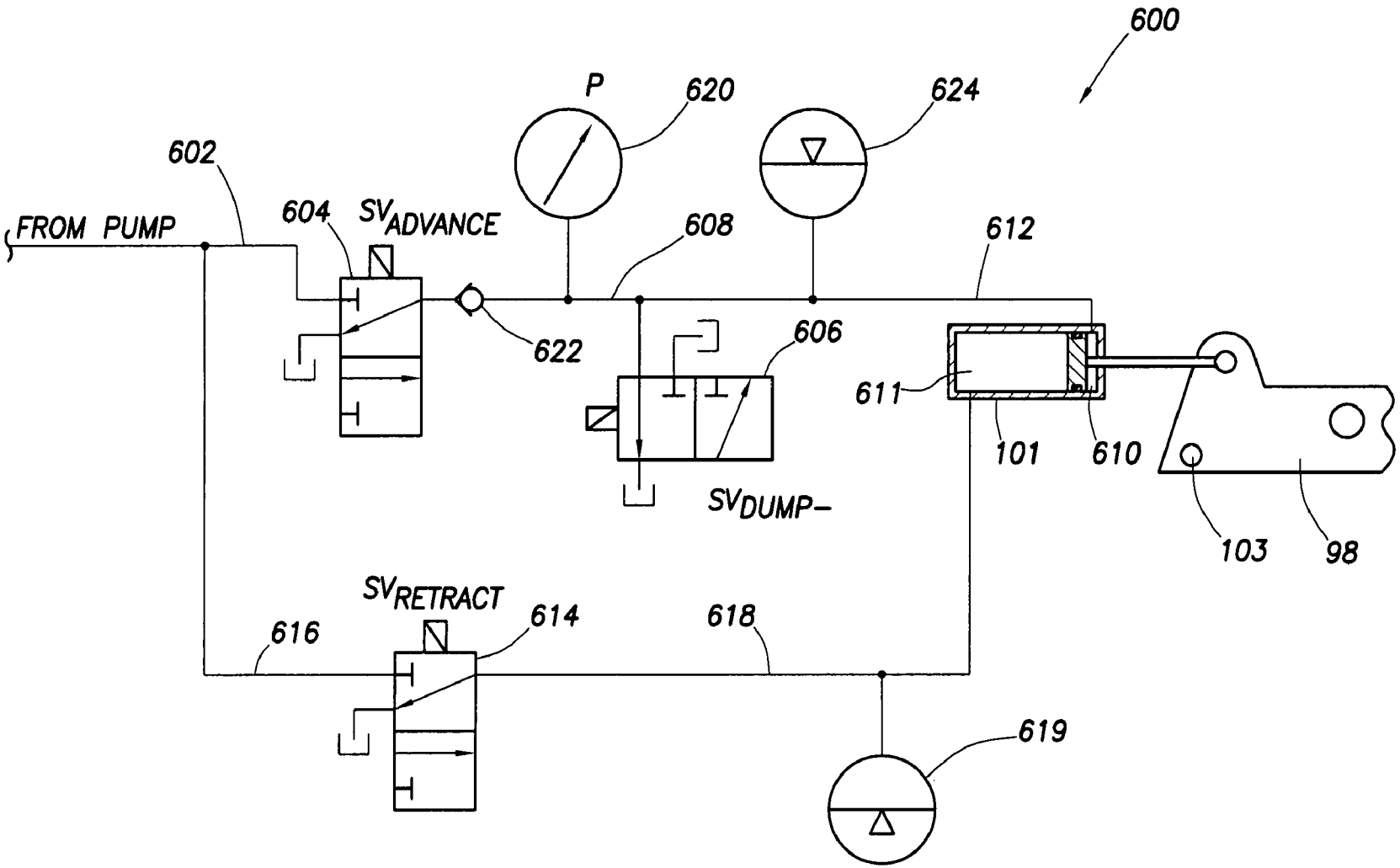
FIG. 6 is a schematic diagram of a bit control circuit in accordance with another aspect of the present invention.

Referring to FIG. 6, the bit control circuit 600 in accordance with the present invention will now be described. The bit control circuit 600 includes an input fluid line 602, which is connected to the hydraulic pump 106. The input fluid line 602 supplies pressurized hydraulic fluid into $SV_{advance}$ control valve 604. In one exemplary embodiment, the $SV_{advance}$ control valve 604 is a three-way, two-position electronically controlled solenoid valve controlled by the tool's electronic control system. In one position (the powered position), the $SV_{advance}$ control valve 604 connects the input fluid line 602 to the rod side 610 of the bit advance piston 101. In the other position (the unpowered position), the $SV_{advance}$ control valve 604 blocks the fluid from hydraulic pump 106. The $SV_{advance}$ control valve 604 operates to supply the bit advance piston 101 with pressurized fluid to advance the coring bit 22 as explained below. As the rod side 610 of bit advance piston 101 fills with pressurized fluid, it forces the bit advance piston 101 to retract, which in turn pivots lever arms 98, 99 about pivot point 103 and thereby advances the coring bit assembly 50 horizontally into the subterranean formation.

The bit control circuit 600 further comprises a $SV_{dump}$ control valve 606, which in one exemplary embodiment is a three-way, two-position electronically controlled solenoid valve also controlled by the tool's electronic control system. In the first position, the $SV_{dump}$ control valve 606 connects fluid line 608 and rod side 610 of bit advance piston 101 via fluid line 612. In the second (unpowered) position, the $SV_{dump}$ control valve 606 connects fluid line 608 to the hydraulic reservoir tank that supplies the hydraulic pump 106. The $SV_{dump}$ control valve 606 thus operates to relieve the pressure of the fluid being supplied to the bit advance piston 101 when the pressure exceeds a desired value.

The bit control circuit 600 further includes a $SV_{retract}$ control valve 614. In one exemplary embodiment, the $SV_{retract}$ control valve 614 is a three-way, two-position solenoid valve. In the first (powered) position, the $SV_{retract}$ control valve 614 connects the input fluid line 602 to the piston side 611 of the bit advance piston 101 via input and output fluid line 616 and fluid control line 618. In the second (unpowered) position, the $SV_{retract}$ control valve 614 blocks the pump pressure and connects fluid control line 618 to the tank. The $SV_{retract}$ control valve 614 operates to retract the coring bit 22 by supplying the piston side 611 of the bit advance piston 101 with pressurized fluid, which in turn advances the piston and correspondingly pivots the lever arms 98, 99 about pivot point 103 in a clockwise direction thereby causing the coring bit assembly 50 to retract away from the subterranean formation. The bit control circuit 600 also includes an accumulator 619 which is connected to fluid control line 618. The accumulator 619 accumulates the fluid during activation of the $SV_{retract}$ control valve 614 to dampen pressure spikes, which would otherwise occur if the $SV_{retract}$ control valve 614 connected the piston side 611 of the bit advance piston 101 directly to the hydraulic pump 106. Accumulator 619 also helps to retract the bit away from the wall if the $SV_{dump}$ control valve 606 is energized to reduce torque instantly.

The bit control circuit 600 further includes a pressure transducer 620, which is disposed in fluid line 608. The pressure transducer 620 sends a feedback signal to the electronic control system, which in turn monitors the pressure being supplied to the bit advance piston 101. $SV_{ADVANCE}$ Control Valve 604, $SV_{DUMP}$ Control Valve 606, and $SV_{RETRACT}$ Control Valve 614 are all electrically connected to the electronic control system and in turn are controlled by that system. In other words, the each of these valves move between the first and second position in response to electronic control signals received from the electronic control system.

The bit control circuit 600 further includes a check valve 622, which is disposed between the pressure transducer 620 and the $SV_{advance}$ control valve 604. The check valve 622 prevents the fluid in fluid line 608 from flowing back to the tank when the $SV_{advance}$ control valve 604 is in the second (unpowered) position. The bit control circuit 600 also includes an accumulator 624 which is connected to fluid line 612. The accumulator 624 accumulates the fluid during activation of the $SV_{advance}$ control valve 604 to dampen pressure spikes, which would otherwise occur if the $SV_{advance}$ control valve 604 connected the rod side 610 of the bit advance piston 101 directly to the hydraulic pump 106. In one exemplary embodiment, the fluid pressure being output by the hydraulic pump 106 is approximately 2,500 psi, and the fluid pressure being supplied to the bit advance piston 101 during advancement of the coring bit assembly 50, is between 1000 psi and 1500 psi. As those of ordinary skill in the art will appreciate, other pressures and pressure ranges may be acceptable depending upon the parameters of the system.

The bit control circuit 600 operates as follows. $SV_{ADVANCE}$ Control Valve 604 and $SV_{RETRACT}$ Control Valve 614 are initially in the closed (unpowered) position and $SV_{dump}$ control valve 606 is in the open position (unpowered). In this position, the $SV_{ADVANCE}$ Control Valve 604 and $SV_{RETRACT}$ Control Valve 614 block pump flow (normally closed) and $SV_{dump}$ control valve 606 allows the flow to go to the tank (normally open). When it is desired to advance the coring bit 22, $SV_{ADVANCE}$ Control Valve 604 and $SV_{DUMP}$ Control Valve 606 are powered, i.e., moved to the first position by the electronic control system via electronic control signals. This connects the rod side 610 of the bit advance piston 101 to the hydraulic pump 106, supplying it with pressurized fluid. Once the fluid pressure reaches the desired range, which in one exemplary embodiment is approximately 1000 to 1500 psi, the $SV_{advance}$ control valve 604 is removed of power. The $SV_{dump}$ control valve 606, however, remains closed (powered). Because the check valve 622 prevents the pressurized fluid from flowing back into the $SV_{advance}$ control valve 604, the fluid lines 608 and 612 remain pressurized. Once the pressure drops below the desired minimum pressure, the $SV_{advance}$ control valve 604 is activated again, i.e., powered, until the pressure is once again back into the desired range. In the event that the fluid pressure exceeds the maximum desired pressure, the $SV_{dump}$ control valve 606 is opened to connect fluid line 612 to the tank and thereby reduce the pressure in the line with the aid of accumulator 619.

When it is desired to stop the coring operation and retract the coring bit 22, e.g., once a core sample has been obtained, the electronic control system sends control signals to $SV_{ADVANCE}$ Control Valve 604 and $SV_{DUMP}$ Control Valve 606 to connect to the tank. At the same time, the electronic control system sends a control signal to the $SV_{retract}$ control valve 614 to connect the piston side 611 of the piston to the hydraulic pump 106. This in turn forces the bit advance piston 101 completely open, thereby retracting the coring bit 22.

Figure 7A:
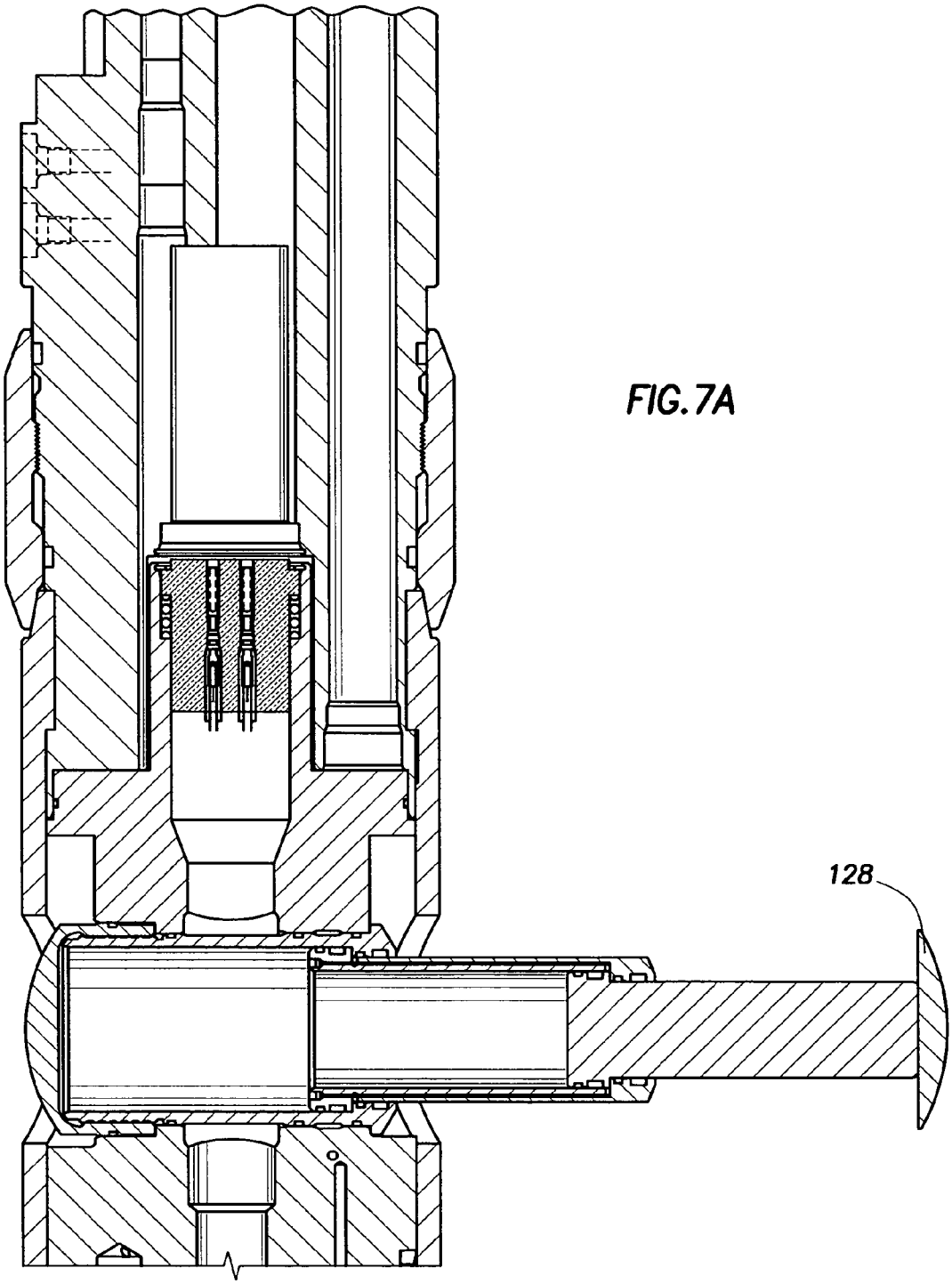
FIGS. 7A-7F illustrate sections of another enlarged longitudinal cross-section of the coring tool in accordance with the present invention illustrating the details of a core sample storage device and back-up pistons in accordance with another aspect of the present invention.
Figure 7B:
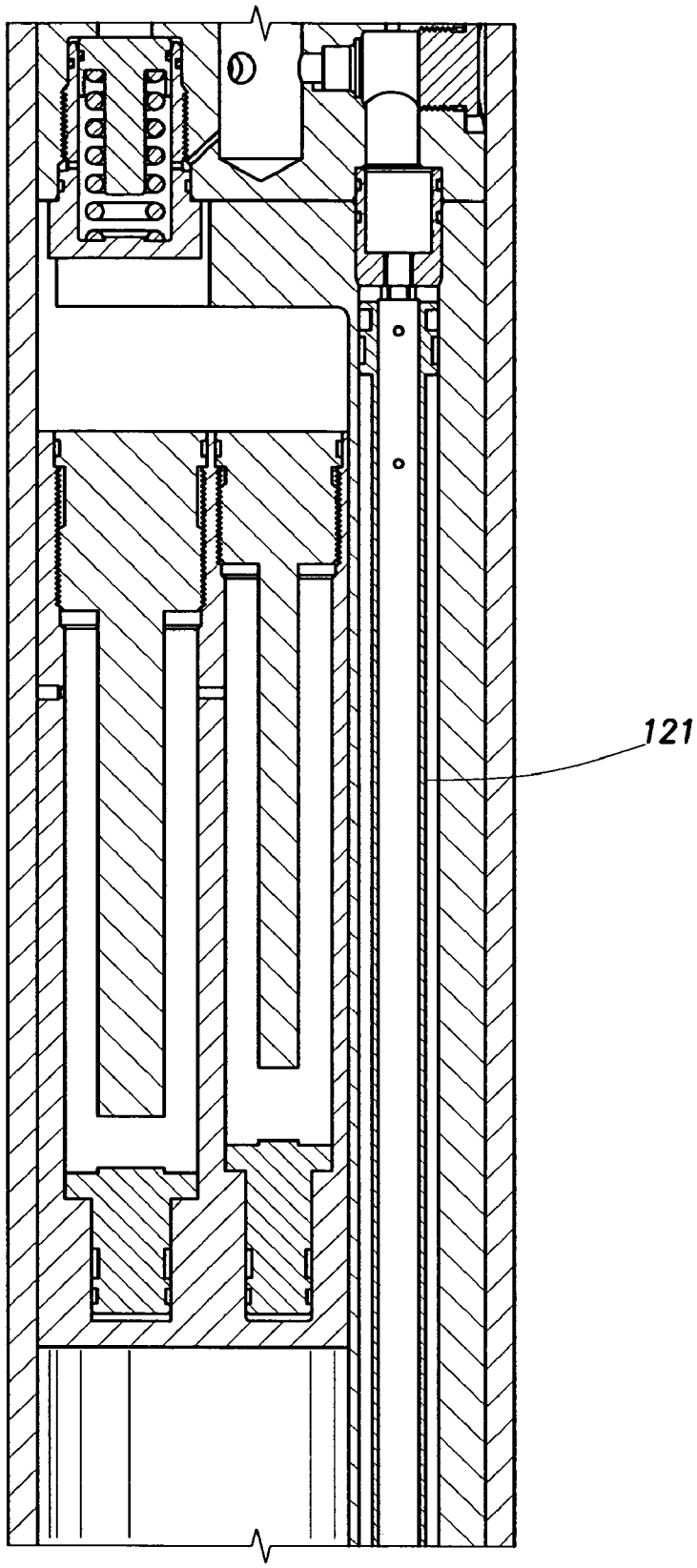
Figure 7C:
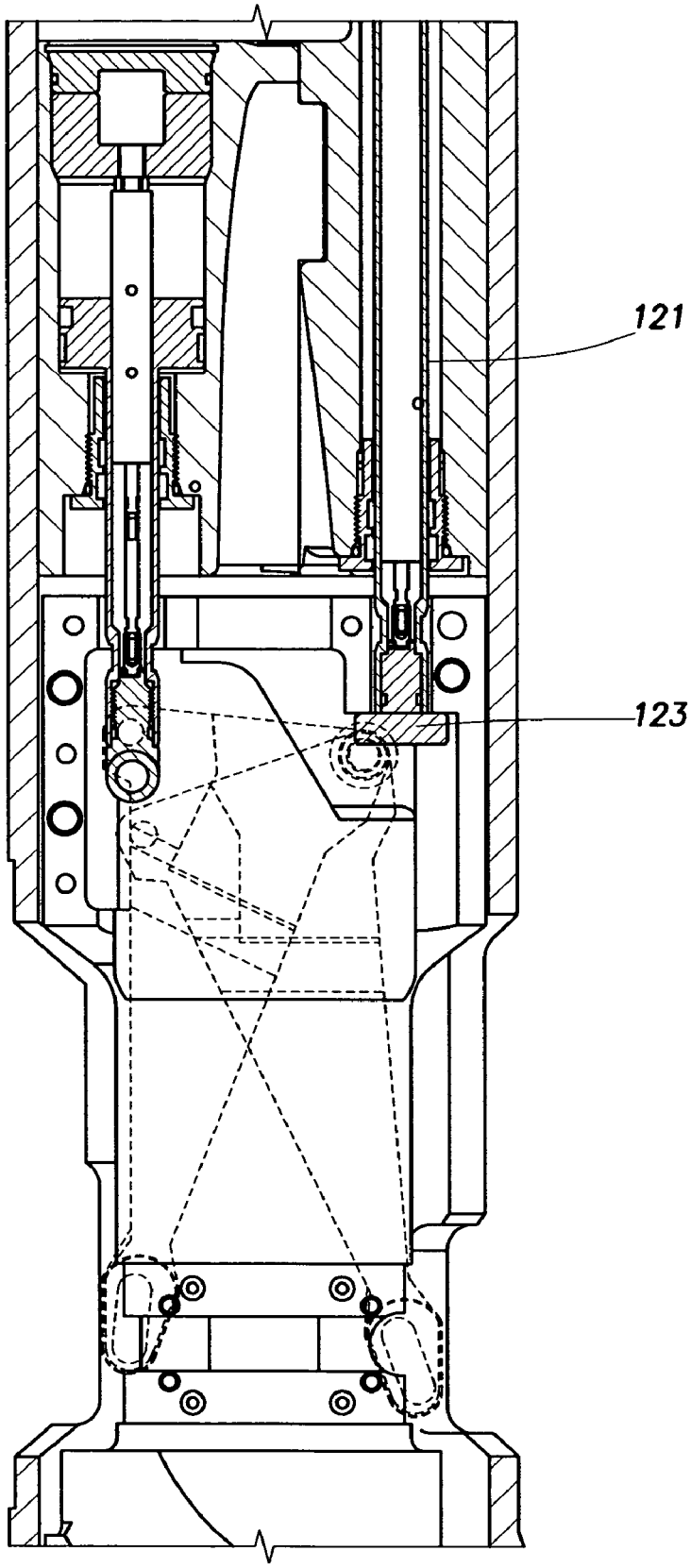
Figure 13B:
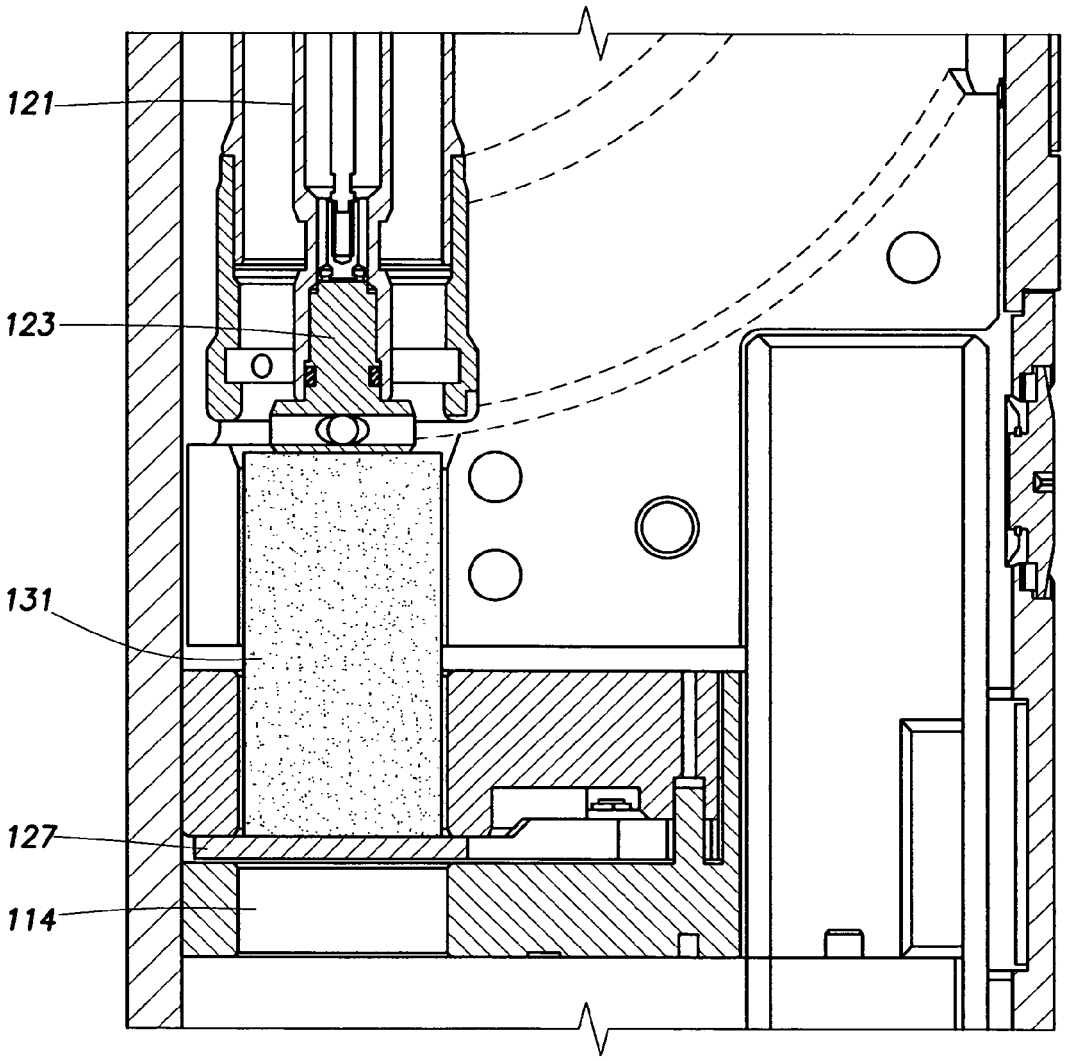
FIG. 13B is a partial cross-sectional view of the coring tool which illustrates the activation of the push rod that forces the coring sample out of the coring bit against a trap door which covers the opening of a sample storage tube.

Next, positioning piston 97 is operated to rotate coring bit assembly 50 from the horizontal operable position to the vertical storage position. Once coring bit assembly 50 is in the vertical storage position, core sample 131 is ready to be measured and then deposited into the core sample storage device, rotatable carousel 54. To measure, the core sample 131, a push rod 121, which is shown in FIGS. 7B and 7C, pushes the core sample 131 out of the coring bit 22 up against a trap door 127, which covers the opening to one of the storage tubes 114, described in more detail below. The push rod 121 is activated via a pressure control valve (not shown) controlled by the electronic control system, which in turn supplies pressurized fluid from the hydraulic pump 106. The push rod 121 has a plunger 123, which pushes the core sample 131 out of the coring bit 22, as shown in FIG. 13B. The trap door 127 (shown in FIG. 13B) closes over the storage tube, when the back-up pistons 128 and 130 are extended. The same fluid that feeds the back-up pistons 128 and 130 to come out, also feeds another piston (not shown) that pushes on a linkage to close the trap door 127. Using a linear potentiometer 129 connected to the push rod 121, the length of the core sample can be determined. The linear potentiometer is a variable resistance device. A precision measurement of position can be made when a moving terminal slides across the resistance element.

After the measurement has been taken, the core sample 131 is ready to be deposited into the core sample storage device. This is done by opening the trap door 127 and activating the push rod 121. The trap door 127 opens when the back-up pistons 128 and 130 are closed. When the back-up pistons 128 and 130 are closed, the same pressure is routed to the back side of the trap door piston to open the door 127. The push rod 121 is then extended once again and this time the core sample 131 will be pushed into a storage tube 114.

Figure 7D:
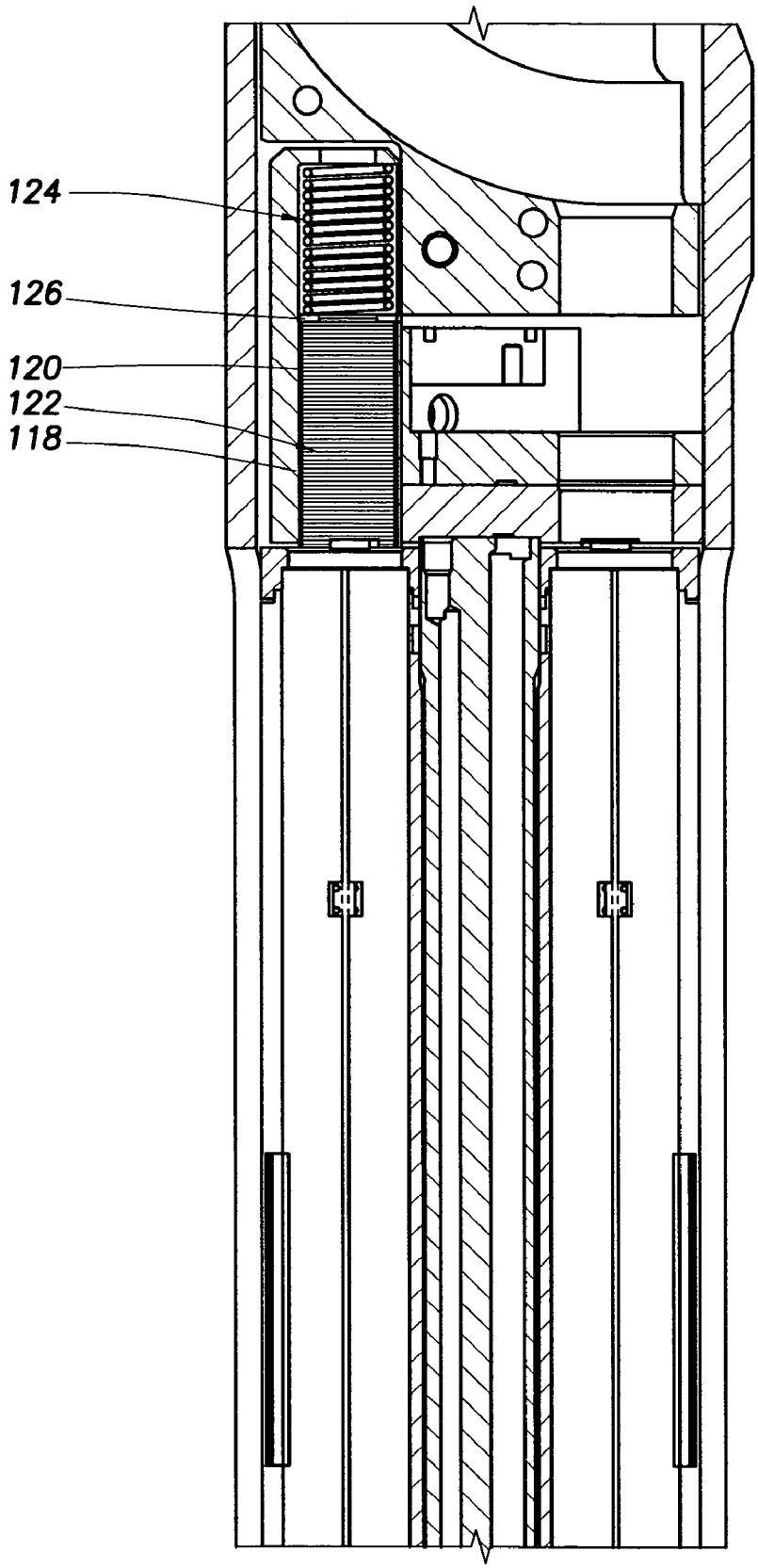
Figure 7E:
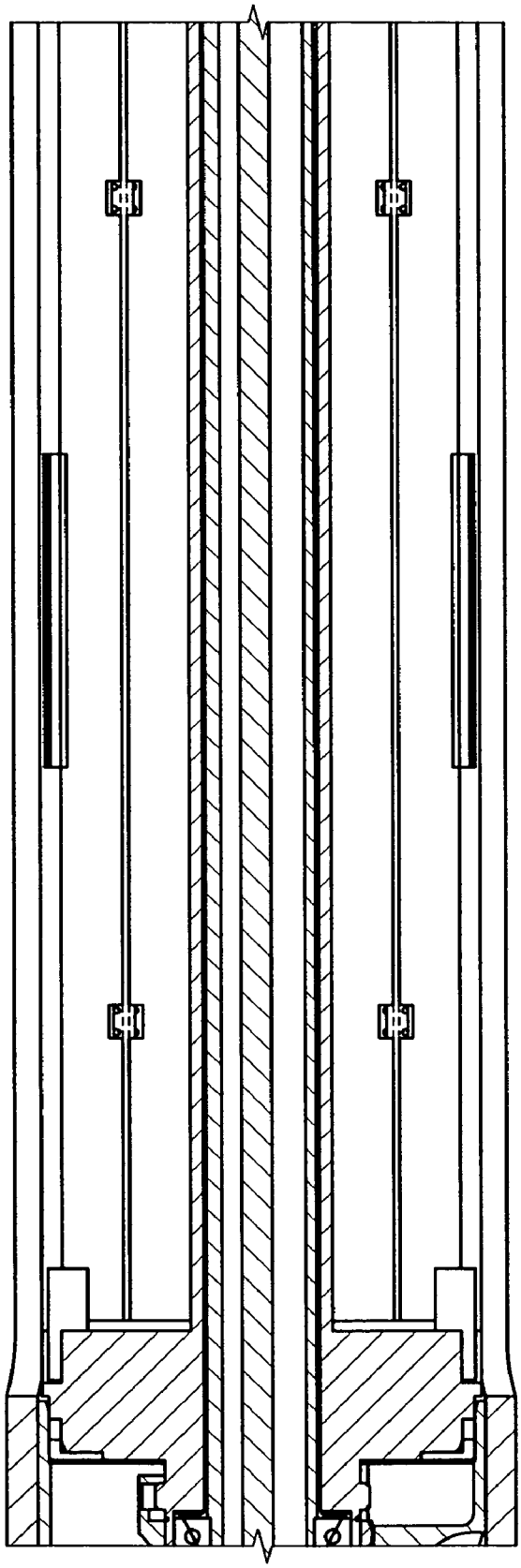
Figure 7F:
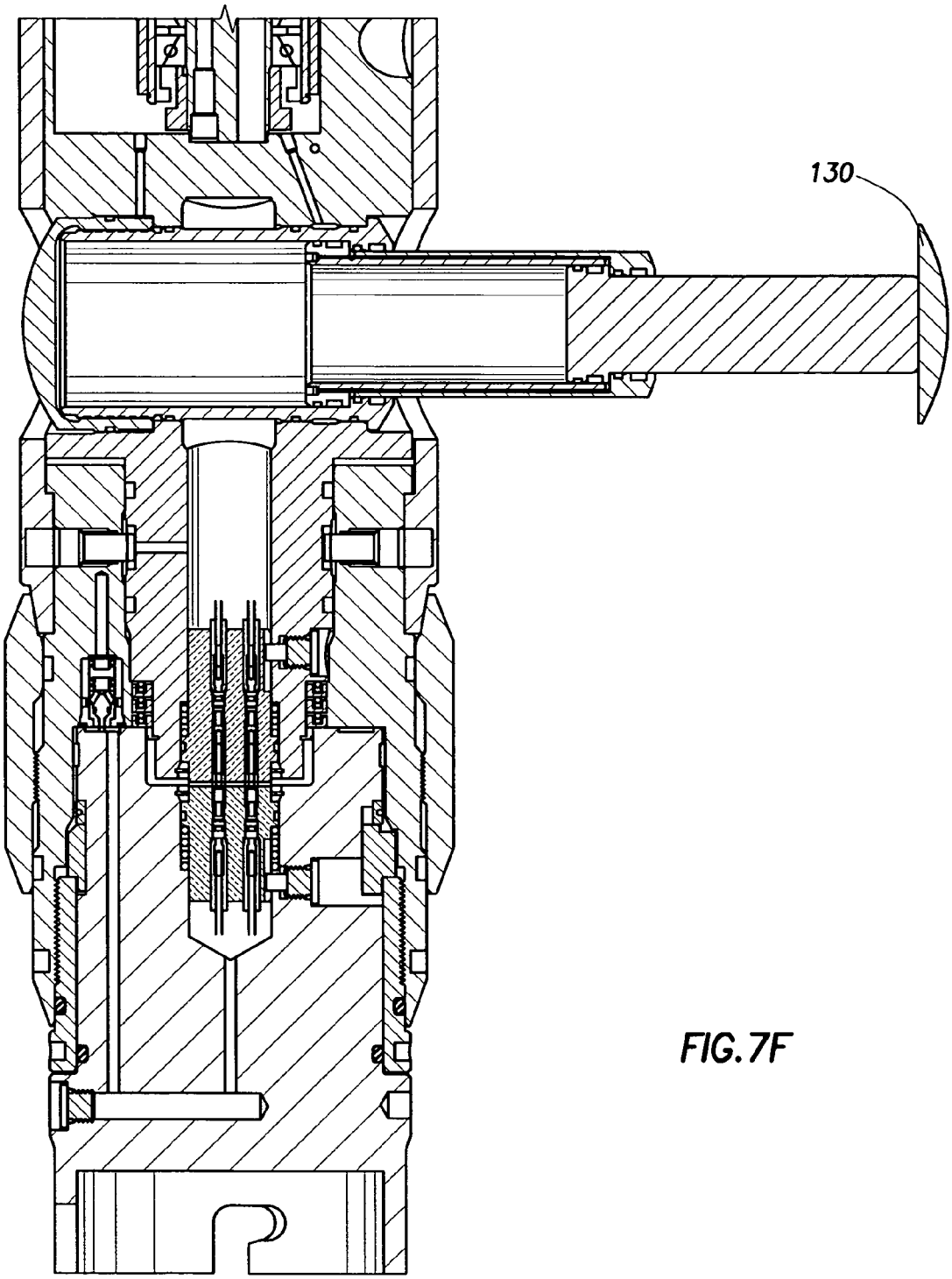
Figure 8:
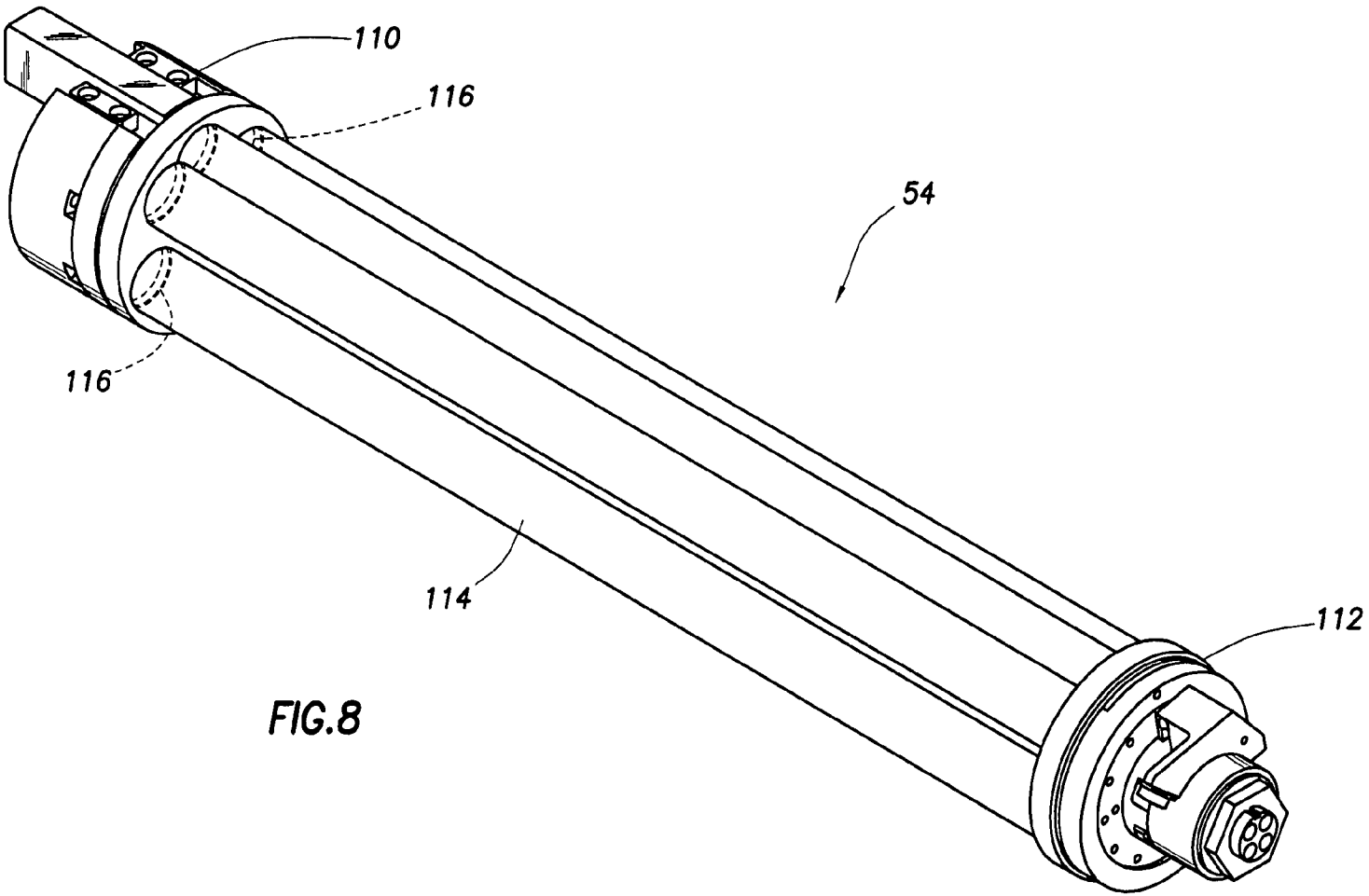
FIG. 8 is a perspective view of a rotary carousel used in storing the core samples in accordance with another aspect of the present invention.

The details of the core sample storage device in connection with the present invention will now be described in connection with FIGS. 7 and 8. The core storage device in accordance with the present invention comprises a rotatable carousel 54, which comprises a pair of support hubs 110 and 112, best seen in FIG. 8. A plurality of removable storage tubes 114 are disposed between support hub 110 and support hub 112. They fit in recesses 116 formed within the support hubs 110 and 112. There are six equally-spaced removable storage tubes mounted around the circumference of the rotatable carousel 54. Removable storage tubes are approximately 20 inches long and capable of storing approximately 10 cores each. Thus, rotatable carousel 54 is capable of storing approximately 60 two-inch long, one-inch diameter core samples. As those of ordinary skill in the art will recognize, however, any number of storage tubes can be used which fit within the design parameters of the tool. Furthermore, the core samples can be of a different size. The rotatable carousel 54 has a larger storage capacity than conventional storage devices and therefore enables the coring tool 10 to store more core samples than conventional devices. Indeed, conventional storage devices typically have one tube arranged lengthwise along the tool and therefore have limited storage capacity. Thus, the coring tool 10 has the benefit of collecting more samples on a single trip and therefore takes less trips into the well bore to collect the desired number of samples than prior art devices.

Figure 9:
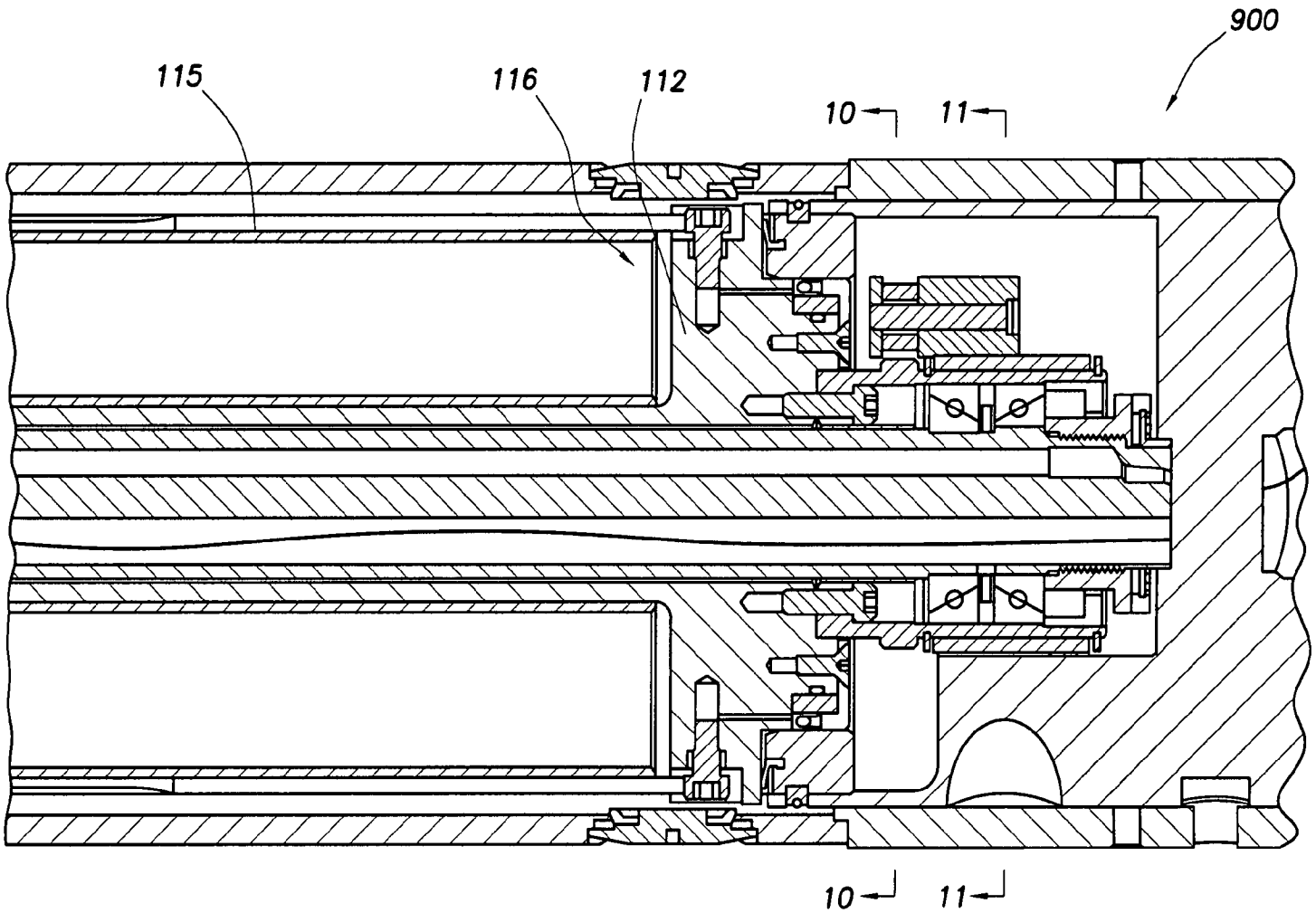
FIG. 9 is an enlarged partial lengthwise cross-sectional view of the ratcheting mechanism used to advance the carousel for storing core samples in accordance with the present invention.
Figure 10:
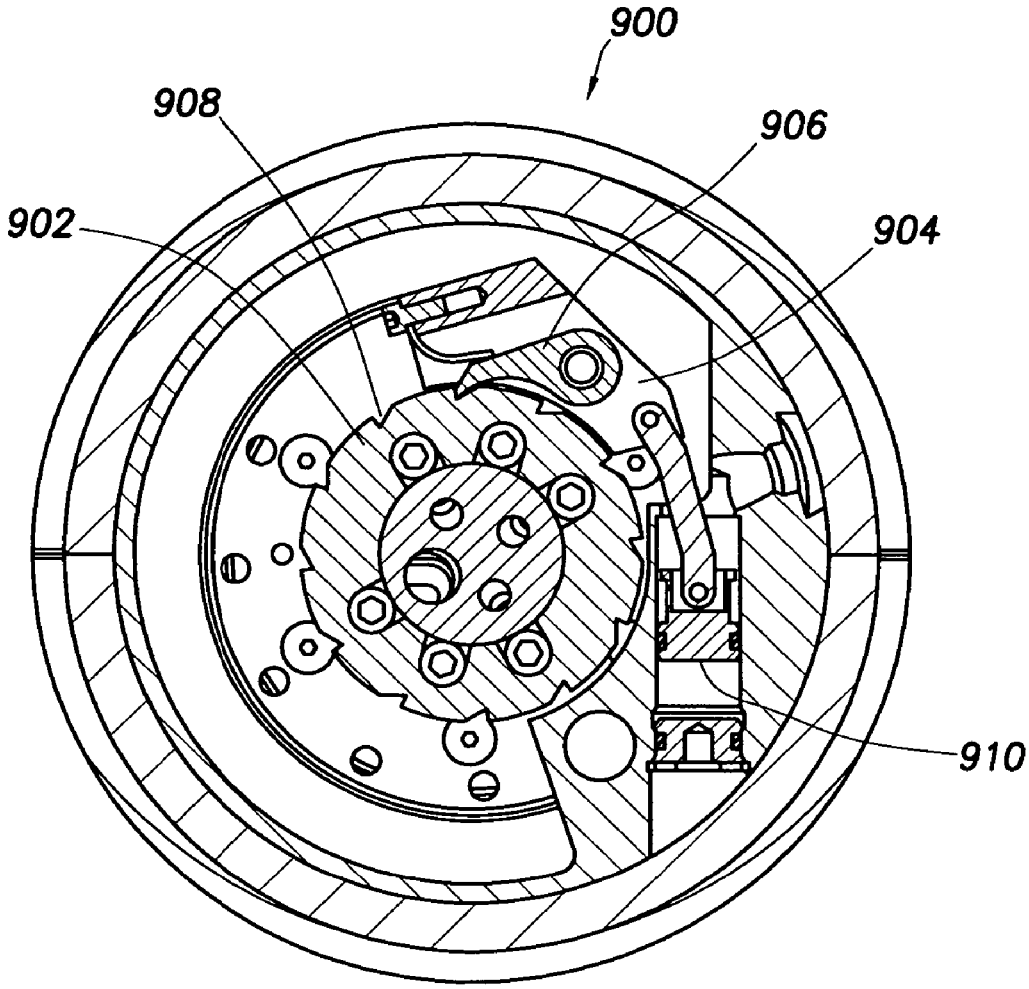
FIG. 10 is an axial cross-sectional view of the ratcheting mechanism used to advance the carousel for storing core samples in accordance with the present invention taken along line 10-10 in FIG. 9.
Figure 11:
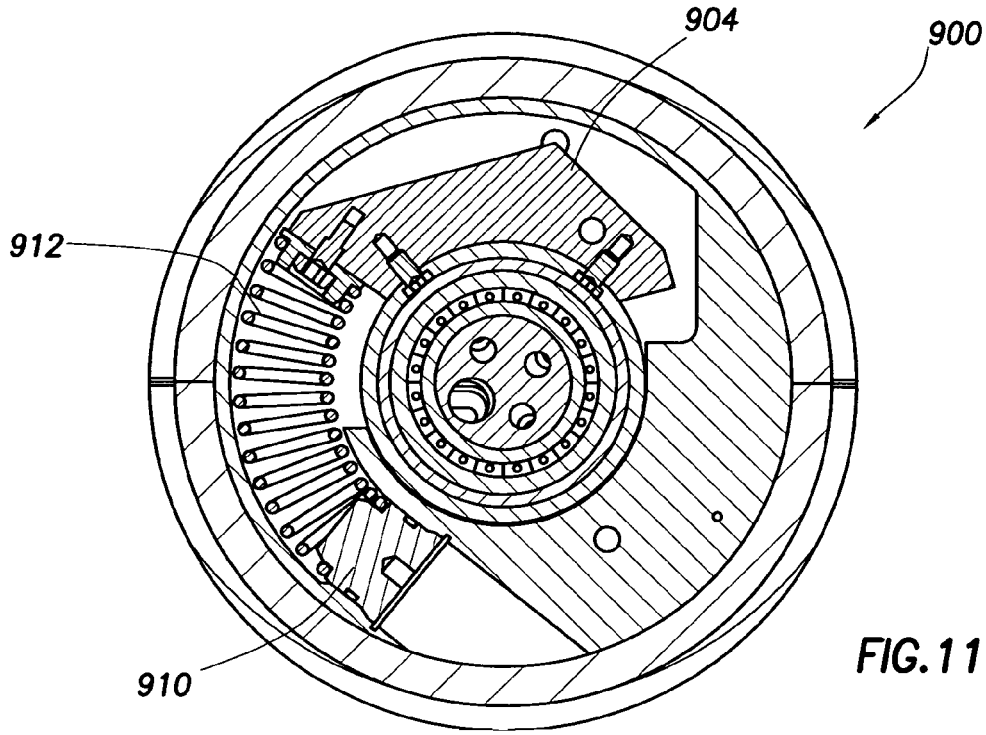
FIG. 11 is another axial cross-sectional view of the ratcheting mechanism used to advance the carousel for storing core sample in accordance with the present invention taken along line 11-11 in FIG. 9.

The rotatable carousel 54 is rotated by operation of a ratcheting mechanism shown generally in FIG. 9 by ratcheting mechanism 900. The details of the ratcheting mechanism 900 are shown in more detail in FIGS. 10 and 11. The ratcheting mechanism 900 includes an indexing wheel 902, which is rotated by rotating arm 904 via indexing finger 906, as shown in FIG. 10. The indexing wheel 902 has a plurality of generally equally spaced notches 908, which are engaged by the indexing finger 906 to advance the indexing wheel 902. The rotating arm 904 is advanced and retracted via a piston 910 and spring 912 (shown in FIG. 11). The hydraulic piston 910 is a single-action piston, which receives pressurized fluid from the hydraulic pump 106 via activation of a fluid control valve (not shown), which is in turn electronically controlled by the surface control unit 20. When the fluid pressure is removed from the piston, the spring 912 forces it in a retracted position, which in turn moves the indexing finger 906 to engage the next notch 908, shown clockwise in FIG. 10. The next time pressurized fluid is supplied to the piston 910, the indexing finger 906 operates to rotate the indexing wheel 902 the distance between adjacent notches 908.

Core sample separating device 118 in accordance with the present invention will now be described. Turning to FIG. 7D, core sample separating device 118 comprises a cylindrical housing 120, which stores a plurality of stacked discs 122. Each of the plurality of stacked discs 122 is labeled with a core sample identification number or other similar designation. Each stacked disc 122 is inserted into a removable storage tube 114 disposed opposite to a corresponding storage tube 114 into which a core sample is being ejected by the coring bit 22. Accordingly, the plurality of stacked discs 122 separate adjacent core samples. The stacked discs 122 are dispensed into the removable storage tubes 114 by a disk dispensing mechanism 124. This disk dispensing mechanism 124 comprises a preloaded spring and dispensing plate 126. A plurality of raised portions or lips 125 mounted on a face of support hub 110 between adjacent storage tubes 114 operate to push the discs 122 into the storage tubes as the lips 125 are rotated into engagement with the stacked discs 122 by the ratcheting mechanism 900.

Figure 12:
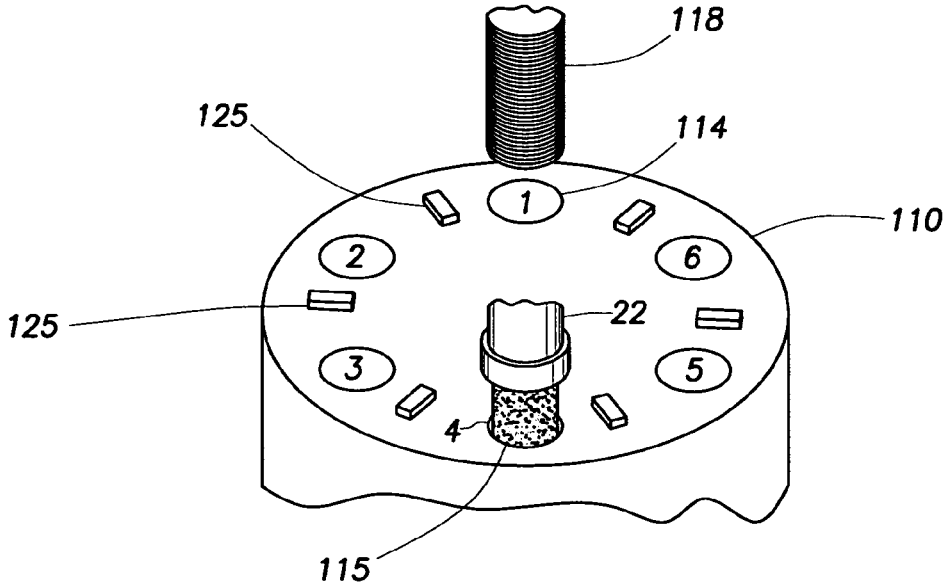
FIG. 12 is an isometric view of the coring bit depositing a sample in one of the storage tubes of the carousel and the core separator device depositing core separator in another one of the storage tubes.

Turning to FIG. 12, it can be seen how the coring bit 22 deposits samples into one of the storage tubes 114 of the rotatable carousel 54, in this example storage tube no. 4, while the core sample separating device 118, shown in FIG. 7D, deposits a disc 122 into storage tube no. 1. Lip 125 pushes the disc 122 into storage tube no. 1 as the ratcheting mechanism 900 rotates the rotatable carousel 54.

Coring tool 10 further comprises a pair of back-up pistons 128 and 130, which are shown in the retracted position in FIGS. 1 and 3 and in the extended position in FIGS. 2 and 7. The back-up pistons 128 and 130 assume the retracted position during positioning of the coring tool 10 within well bore 14. Back-up pistons 128 and 130 assume their extended position once the coring bit 22 is positioned in a desired location for obtaining a core sample. Back-up pistons 128 and 130 are hydraulically operated through a hydraulic fluid which is supplied to back-up pistons by a hydraulic fluid control line, which is connected to the section 40. The section 40 receives a control signal from the electronic control system to open a valve, which in turn connects back-up pistons 128 and 130 to pressurized hydraulic fluid supplied by the hydraulic pump 106. This in turn extends back-up pistons 128 and 130 into engagement with the sidewall 16. The section 40 receives a control signal from the electronic control system to close the valve thereby removing the pressurized hydraulic fluid in back-up pistons 128 and 130 and thereby causing them to retract, which in turn disengages the coring tool 10 from the well bore wall.

Operation of the coring tool 10 in accordance with the present invention will now be described. The coring tool 10 in accordance with the present invention is positioned within well bore 14 adjacent sidewall 16 in the area of the subterranean formation of interest. Back-up pistons 128 and 130 are activated thereby positioning the coring tool 10 against sidewall 16. The positioning piston 97 and bit advance piston 101 also controlled by section 40 which receives control signals from surface control unit 20 will operate linkage assemblies 88 and 90 so as to move the coring bit 22 from the vertical storage position to a horizontal operable position and thereafter laterally advance the coring bit 22 into engagement with sidewall 16. Torque sensor 80 and pressure transducer 620 provide feedback signals to the electronic control system. These control signals supply the electronic control system with the rpm of the bit, a phase shift between the two reluctance sensors from which torque can be derived, and the fluid pressure being supplied to the coring bit, which in turn is indicative of the lateral position of the coring bit 22 relative to the subterranean formation. In the event that the coring bit 22 gets stuck or cannot operate at the desired rpm and/or torque, the electronic control system can reduce the torque on the coring bit 22 or retract the bit completely, if needed.

Once the core sample 131 has been cut from sidewall 16 of the subterranean formation, the coring bit 22 is rotated from the horizontal operable position to the vertical storage position. The tool 10 then measures the core sample 131 and deposits it in the removable storage tube 114. The disk dispensing mechanism 124 then dispenses a labeled disk into the removable storage tube 114 opposite the one into which the core sample 131 is deposited. The back-up pistons 128 and 130 are then retracted and the coring tool 10 is ready to be moved to the next area in the subterranean formation from which a core sample will be obtained. This process is repeated until all of the core samples are collected or the rotatable carousel 54 is full, after which the coring tool 10 is pulled out of the well bore 14. Once all of the removable storage tubes 114 have been emptied and placed back into the rotatable carousel 54, the coring tool 10 is ready for use again either in well bore 14 or another well bore in another subterranean formation.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A rotary sidewall coring tool, comprising:

a drive motor;

a drive shaft coupled to the drive motor;

a hydraulic pump coupled to the drive motor, which drives auxiliary devices;

a coring bit coupled to the drive shaft, such that the coring bit is directly driven by the drive motor; and a clutch coupled to the drive shaft.

2. The rotary sidewall coring tool according to claim 1, wherein the drive shaft comprises a flexible drive shaft.

3. The rotary sidewall coring tool according to claim 1, wherein the clutch comprises a pair of clutch plates.

4. The rotary sidewall coring tool according to claim 3, further comprising a gear assembly, which couples to the drive shaft.

5. The rotary sidewall coring tool according to claim 4, wherein the gear assembly axially offsets the rotational output of the drive shaft.

6. The rotary sidewall coring tool according to claim 1, further comprising a sensor mounted adjacent to the drive shaft that communicates a signal to an electronic control system that is indicative of the rpm of the drive shaft and from which a torque of a drive shaft can be calculated.

7. The rotary sidewall coring tool according to claim 6, wherein the sensor comprises a pair of reluctance sensors secured to a fixed mount adjacent to a flexible spring having two opposing ends which is coupled to the drive shaft and wherein each of the pair of reluctance sensors is disposed adjacent to one of the opposing ends of the flexible spring.

8. The rotary sidewall coring tool according to claim 1, wherein the drive motor is an electric motor.

9. The rotary sidewall coring tool according to claim 1, further comprising a platform on which the coring bit is mounted and a first lever arm mounted to the platform, the first lever arm operated to rotate the coring bit from a vertical storage position to a horizontal operable position.

10. The rotary sidewall coring tool according to claim 9, wherein the first lever arm is coupled to a first hydraulically driven piston, which is driven by a hydraulic pump in turn driven by the drive motor, and wherein the first lever arm translates linear motion into rotational motion.

11. The rotary sidewall coring tool according to claim 10, further comprising a second lever arm mounted to the bit platform, which operates to move the coring bit laterally out of the rotary sidewall coring tool into contact with a subterranean formation to be sampled.

12. The rotary sidewall coring tool according to claim 11, wherein the second lever arm is coupled to a second hydraulically driven piston, which is driven by a hydraulic pump in turn driven by the drive motor, and wherein the second lever arm translates axial motion into lateral motion.

13. The rotary sidewall coring tool according to claim 12, further comprising a bit control circuit in fluid communication with the second hydraulically driven piston, which operates to control the advancement of the bit into the formation in response to the pressure of the fluid in the circuit.

14. The rotary sidewall coring tool according to claim 1, further comprising a rotating carousel disposed adjacent to the coring bit, the rotating carousel having a plurality of tubes, which store multiple core samples each.

15. The rotary sidewall coring tool according to claim 14, wherein the plurality of storage tubes are mounted between a pair of support hubs connected to each other by a central shaft, and wherein the plurality of storage tubes are equally spaced around a circumference of the rotating carousel.

16. The rotary sidewall coring tool according to claim 15, wherein the rotating carousel is driven by a linkage that translates linear motion into rotational motion, and wherein the linkage is attached to and driven by a hydraulic pump, which is in turn driven by the drive motor.

17. The rotary sidewall coring tool according to claim 16, further comprising a core separator disposed adjacent to the rotating carousel, which comprises a plurality of labeled discs that identify each core sample collected and a spring loaded plunger that dispenses a labeled disc with each core sample loaded into the rotating carousel.

18. The rotary sidewall coring tool according to claim 1, further comprising at least one back-up piston disposed within the tool, which upon activation thrusts the tool against one side of a well bore, wherein the at least one back-up piston is driven by a hydraulic pump, which is in turn driven by the drive motor.

19. The rotary sidewall coring tool according to claim 1, further comprising a plurality of intermeshing bevel gears that couple the drive shaft to the coring bit.

20. A method of coring a borehole in a hard rock subterranean formation, comprising the steps of:

(a) activating a drive motor to rotate an output shaft;

(b) coupling the output shaft of the drive motor to a flexible drive shaft using a clutch;

(c) rotating a coring bit with the flexible drive shaft; and (d) driving auxiliary devices with a hydraulic pump driven by the drive motor.

21. The method of coring a borehole according to claim 20, further comprising the step of rotating the coring bit from a vertical storage position to a horizontal operable position.

22. The method of coring a borehole according to claim 21, wherein the step of rotating the coring bit is performed by activating a hydraulic piston driven by a hydraulic motor in turn driven by the drive motor to move a lever arm, which is adapted to translate linear motion into rotational motion.

23. The method of coring a borehole according to claim 20, further comprising the step of advancing the coring bit laterally into the hard rock subterranean formation.

24. The method of coring a borehole according to claim 23, wherein the step of advancing the coring bit is performed by activating a hydraulic piston driven by a hydraulic motor in turn driven by the drive motor to move a lever arm, which is adapted to translate linear motion into lateral motion.

25. The method of coring a borehole according to claim 20, further comprising the step of reducing the rotational speed being transmitted to the flexible drive shaft by the output shaft of the drive motor.

26. The method of coring a borehole according to claim 20, further comprising the step of providing a feedback signal to an electronic control system, which is indicative of the rpm and torque of the coring bit.

27. The method of coring a borehole according to claim 20, further comprising the step of controlling the advancement of the coring bit in response to a pressure of a fluid being supplied to a hydraulic piston that drives the advancement of the coring bit.

28. The method of coring a borehole according to claim 20, further comprising the step of discharging a core sample from the coring bit into a rotating carousel.

29. The method of coring a borehole according to claim 28, further comprising the step of dispensing a labeled disc into the rotating carousel with the sample core.

30. The method of coring a borehole according to claim 20, further comprising the step of thrusting the coring bit against one side of a well bore.

31. The method of measuring a core sample cut from a subterranean formation by a coring bit, comprising the steps of:

(a) cuffing the core sample from the subterranean formation with the coring bit;

(b) rotating the coring bit from a horizontal cutting position to a vertical storage position;

(c) pushing the core sample out of the coring bit up against a hydraulic trap door covering an opening to a core sample storage tube;

(d) measuring the length of the core sample with a potentiometer;

(e) opening the hydraulic trap door;

(f) depositing the core sample into the core sample storage tube; and (g) closing the hydraulic trap door.

32. The method of measuring a core sample according to claim 31 wherein the core sample is pushed out of the coring bit using a push rod.

33. The method of measuring a core sample according to claim 32, wherein the potentiometer is connected to the push rod.

34. A rotary sidewall coring tool, comprising:

a drive motor;

a drive shaft coupled to the drive motor;

a coring bit coupled to a drive shaft, such that the coring bit is directly driven by the drive motor;

a sensor mounted adjacent to the drive shaft that communicates a signal to an electronic control system that is indicative of the rpm of a drive shaft and from which a torque of a drive shaft can be calculated;

wherein the sensor comprises a pair of reluctance sensors secured to a fixed mount adjacent to a flexible spring having two opposing ends which is coupled to the drive shaft and wherein each of the pair of reluctance sensors is disposed adjacent to one of the opposing ends of the flexible spring; and a clutch coupled to the drive shaft.

35. The rotary sidewall coring tool according to claim 34, further comprising a rotating carousel disposed adjacent to the coring bit, the rotating carousel having a plurality of tubes disposed between opposing support hubs, which store multiple core samples each.

36. The rotary sidewall coring tool according to claim 35, wherein the plurality of storage tubes are equally spaced around a circumference of the rotating carousel.

37. The rotary sidewall coring tool according to claim 35, wherein the rotating carousel is rotated by a ratcheting mechanism mounted to one of the support hubs.

38. The rotary sidewall coring tool according to claim 37, wherein the ratcheting mechanism comprises an indexing wheel, which is rotated by rotating arm via an indexing finger attached thereto.

39. The rotary sidewall coring tool according to claim 38, wherein the indexing wheel comprises a plurality of generally equally-spaced notches, which are engaged by the indexing finger so as to advance the indexing wheel and the rotating arm is advanced and retracted via a single-action hydraulic piston and spring.

40. The rotary sidewall coring tool according to claim 35, further comprising a core separator disposed adjacent to the rotating carousel, which comprises a plurality of labeled discs that identify each core sample collected and a spring loaded plunger that dispenses a labeled disc with each core sample loaded into the rotating carousel.

41. A rotary sidewall coring tool, comprising:

a drive motor;

a drive shaft coupled to the drive motor;

a coring bit coupled to the drive shaft, such that the coring bit is directly driven by the drive motor;

at least one back-up piston disposed within the tool, which upon activation thrusts the tool against one side of a well bore, wherein the at least one back-up piston is driven by a hydraulic pump, which is in turn driven by the drive motor; and a clutch coupled to the drive shaft.

42. The rotary sidewall coring tool according to claim 41, further comprising a plurality of intermeshing bevel gears that couple the drive shaft to the coring bit.

43. A method of coring a borehole in a hard rock subterranean formation, comprising the steps of:

(a) activating a drive motor to rotate an output shaft;

(b) coupling the output shaft of the drive motor to a flexible drive shaft using a clutch;

(c) rotating a coring bit with the flexible drive shaft; and (d) providing a feedback signal to an electronic control system, which is indicative of the rpm and torque of the coring bit.

44. The method of coring a borehole according to claim 43, further comprising the step of discharging a core sample from the coring bit into a rotating carousel.

45. A method of coring a borehole in a hard rock subterranean formation, comprising the steps of:

(a) activating a drive motor to rotate an output shaft;

(b) coupling the output shaft of the drive motor to a flexible drive shaft using a clutch;

(c) rotating a coring bit with the flexible drive shaft; and (d) controlling the advancement of the coring bit in response to a pressure of a fluid being supplied to a hydraulic piston that drives the advancement of the coring bit.

46. The method of coring a borehole according to claim 45, further comprising the step of rotating the coring bit from a vertical storage position to a horizontal operable position.

47. The method of coring a borehole according to claim 46, wherein the step of rotating the coring bit is performed by activating a hydraulic piston driven by a hydraulic motor in turn driven by the drive motor to move a lever arm, which is adapted to translate linear motion into rotational motion.

* * * * *